US010907596B2

(12) United States Patent
Zhang et al.

(10) Patent No.: US 10,907,596 B2
(45) Date of Patent: Feb. 2, 2021

(54) FUEL INJECTOR NOZZLE

(71) Applicant: Ford Global Technologies, LLC, Dearborn, MI (US)

(72) Inventors: Xiaogang Zhang, Novi, MI (US); Jianwen James Yi, West Bloomfield, MI (US); Mark Meinhart, Dexter, MI (US); Shengqi Wu, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 16/427,213

(22) Filed: May 30, 2019

(65) Prior Publication Data

US 2020/0378348 A1 Dec. 3, 2020

(51) Int. Cl.

| | |
|---|---|
| ***F02M 51/06*** | (2006.01) |
| ***B05B 1/30*** | (2006.01) |
| ***B05B 1/02*** | (2006.01) |

(52) U.S. Cl.

CPC ..... *F02M 51/0653* (2013.01); *B05B 1/02* (2013.01); *B05B 1/3053* (2013.01)

(58) Field of Classification Search

CPC ..... F02M 51/06; F02M 51/0653; B05B 1/02; B05B 1/3053

See application file for complete search history.

(56) References Cited

U.S. PATENT DOCUMENTS

| | | | | |
|---|---|---|---|---|
| 4,621,772 | A | 11/1986 | Blythe et al. | |
| 4,699,323 | A | 10/1987 | Rush et al. | |
| 4,971,254 | A | 11/1990 | Daly et al. | |
| 5,035,358 | A | 7/1991 | Katsuno et al. | |
| 5,174,505 | A | 12/1992 | Shen | |
| 5,397,055 | A | 3/1995 | Paul et al. | |
| 5,996,558 | A | 12/1999 | Ouellette et al. | |
| 6,029,913 | A | 2/2000 | Stroia et al. | |
| 6,105,884 | A | 8/2000 | Molnar et al. | |
| 6,302,080 | B1 | 10/2001 | Kato et al. | |
| 6,722,340 | B1 | 4/2004 | Sukegawa et al. | |
| 6,783,085 | B2 | 8/2004 | Xu | |
| 6,817,545 | B2 | 11/2004 | Xu | |
| 9,840,994 | B2 * | 12/2017 | Zhang | F02M 51/06 |
| 9,845,780 | B2 * | 12/2017 | Zhang | F02D 41/20 |
| 2002/0170987 | A1 | 11/2002 | Aoki et al. | |
| 2005/0284965 | A1 | 12/2005 | Schneider | |
| 2014/0291418 | A1 | 10/2014 | Ruffing et al. | |

* cited by examiner

*Primary Examiner* — Hieu T Vo

(74) *Attorney, Agent, or Firm* — Geoffrey Brumbaugh; McCoy Russell LLP

(57) ABSTRACT

Methods and systems are provided for a fuel injector for an engine. In one example, the injector may be adapted with a plurality of nozzles configured to enhance atomization of fuel. The plurality of nozzles may have geometries that increase turbulence and rotation of fuel flow therethrough. In some examples, the injector may also include a multi-stage counterbore that reduces a likelihood of coking at the injector.

17 Claims, 9 Drawing Sheets

FUEL INJECTOR NOZZLE

FIELD

The present description relates generally to methods and systems for an engine fuel injector.

BACKGROUND/SUMMARY

Internal combustion engines generate torque via combustion of air/fuel mixtures at combustion chambers. The fuel may be mixed with air either directly at the combustion chambers or upstream of the combustion chambers to enable ignition of a homogeneous mixture of fuel and air. In order to provide efficient mixing of the fuel with air, the fuel may be injected through an injector that atomizes the fuel, enhancing a surface area to volume ratio of the fuel droplets to increase vaporization and subsequent combustion of the fuel. Atomization may be facilitated by forcing pressurized fuel through a tip of the injector, equipped with a narrow-diameter passage, or nozzle, to disperse the high pressure fuel stream as a mist when the fuel passes through the nozzle. By decreasing a hydraulic diameter of the nozzle, atomization may be increased.

However, a spray of fuel discharged by the nozzle may be inconsistent and non-uniform. The non-uniform spray may lead to loss of fuel, deposition of fuel onto the nozzle, and reduced fuel efficiency. In some examples, variable delivery of fuel to the combustion chambers may cause engine misfire and increased emissions.

Attempts to address inconsistent fuel spray include adapting a nozzle tip with multiple outlet flow paths to adjust the spray of fuel. One example approach is shown by Stroia et al. in U.S. Pat. No. 6,029,913. Therein, an injector nozzle housing is equipped with a swirl tip that increases fuel atomization during injection. The swirl tip includes a plurality of curvilinear spray holes having an approximately 90 degree angle of curvature that enables fuel to flow through a tangential flow path, generating swirl within the spray holes. By swirling the fuel, the fuel droplets break up and spread when exiting the spray holes, thereby enhancing vaporization.

However, the inventors herein have recognized potential issues with such systems. As one example, while the spray holes may impart swirling of fuel that assists in reducing a drop size of the fuel, a pressure gradient may form along the length of the nozzle, with a lower pressure at an outlet of the nozzle than at an inlet where fuel is introduced. A loss of pressure across the nozzle may reduce a velocity of the fuel as the fuel exits the nozzle, resulting in a weakened spray and loss of fuel. However, simply reducing the nozzle length to reduce this pressure drop may result in structural integrity issues at the bottom of the injector body. For example, the bottom of the injector body is subject to high fuel pressure inside the injector sac volume during injection and thus if the bottom of the injector body is too thin, the structural integrity may be compromised. In addition, adjustments to a geometry of the nozzle may preclude reducing a diameter of the nozzle due to an increased likelihood of coking when the nozzle is shortened, resulting to exposure of the nozzle to high temperature gas flow.

In one example, the issues described above may be addressed by a method for a fuel injector, including actuating an injector needle from a first position to a second position to open a venturi-shaped primary nozzle of the fuel injector and a plurality of secondary nozzles circumferentially arranged around the primary nozzle, and delivering fuel from an injector sac of the fuel injector to a cylinder of an engine via the primary nozzle, the plurality of secondary nozzles, a first stage of a counterbore coupled to the primary nozzle and the plurality of secondary nozzles, and a second stage of the counterbore coupled to the first stage. In this way, a length and a diameter of the flow passages through the injector nozzle tip may be reduced to enable increased spray atomization while maintaining a structural integrity of the injector.

As one example, the injector may be equipped with a multi-nozzle, multi-stage counterbore injector tip that drives rotational fuel flow through a set of nozzles with increased cavitation to circumvent coking. A primary nozzle and secondary nozzles of the set of nozzles have different geometries with different effects on fuel flow, such as inducing rotation and increasing turbulence of the flow as the fuel enters the engine cylinder. The multi-stage counterbore allows the lengths and diameters of the set of nozzles to be decreased by directing fuel flow away from outlets of the set of nozzles while increasing the thickness/stability of the bottom of the injector body. Decreasing dimensions of the nozzles and configuring the nozzles to impart swirling of fuel decreases fuel losses during injection. As such, a fuel efficiency of an engine is increased and a useful life of the injector is prolonged.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 2-16 are shown approximately to scale

DETAILED DESCRIPTION

Figure 2:
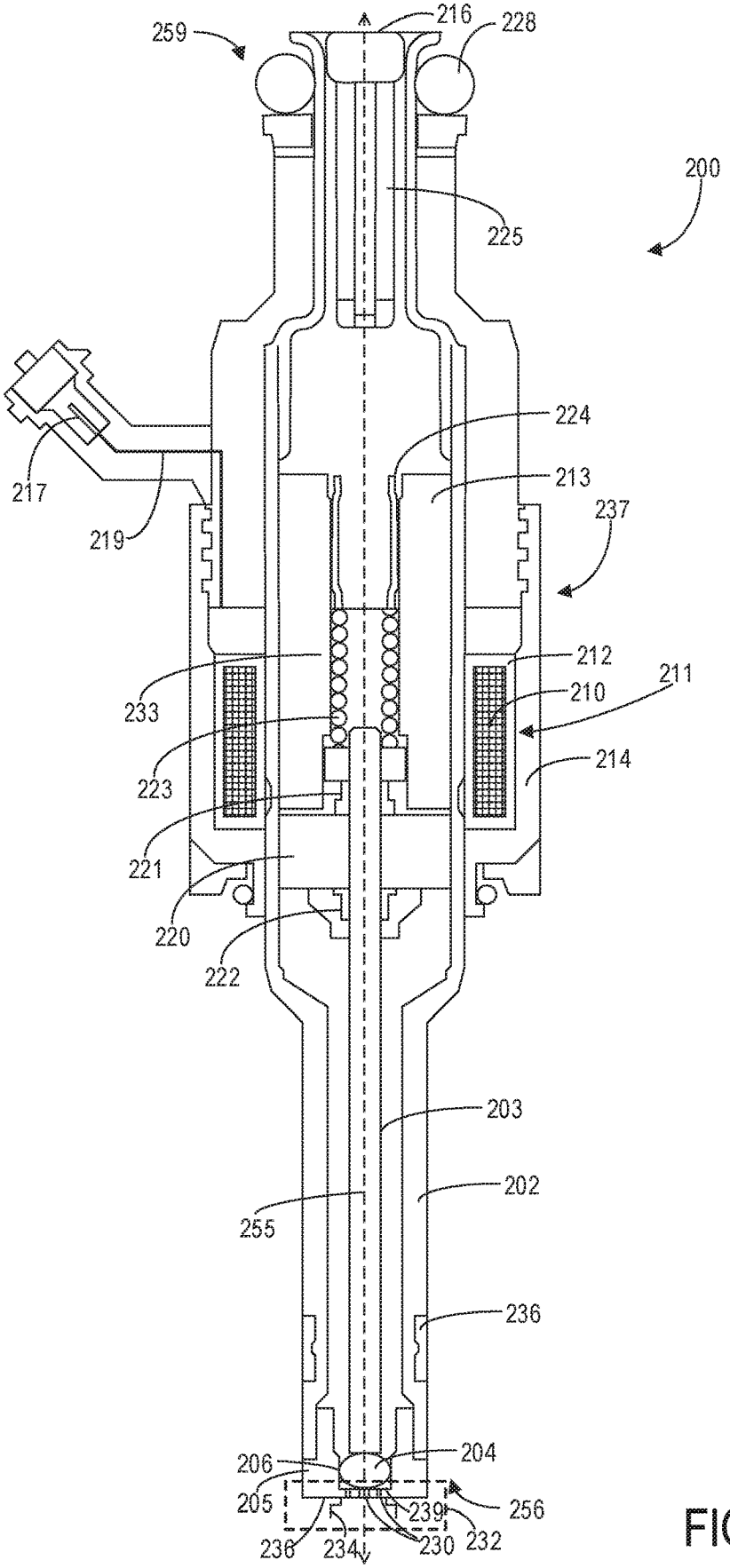
FIG. 2 shows an example of an injector that may include an injector tip adapted with multiple nozzles.
Figure 3:
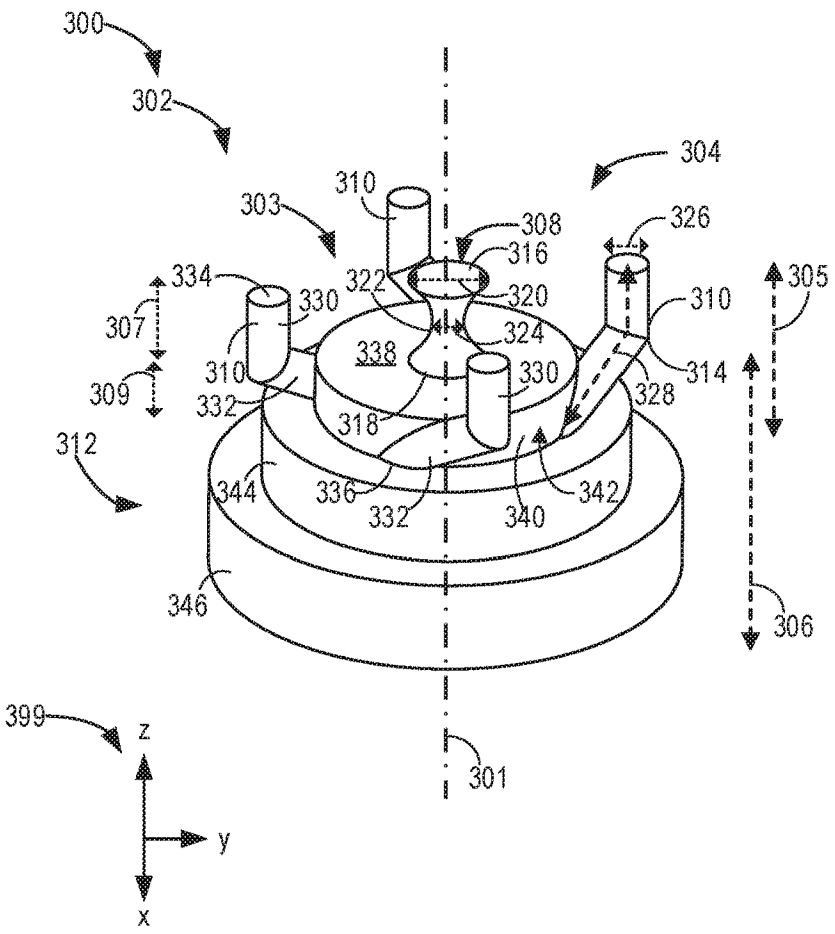
FIG. 3 shows a first perspective view of a first embodiment of a multi-nozzle injector tip.

The following description relates to systems and methods for a fuel injector. The fuel injector may deliver fuel to combustion chambers of an engine. An example of an engine equipped with at least one combustion cylinder adapted with one or more fuel injectors is shown in a schematic diagram in FIG. 1. A detailed view of the fuel injector is depicted in FIG. 2. Atomization of fuel by the fuel injector may be enhanced by adapting the injector with a multi-nozzle, multi-stage counterbore injector tip that includes a plurality of nozzles to drive turbulence and swirling of fuel flow. The injector tip may also have a set of stages forming the counterbore that increases an exit velocity of the fuel flow. A first example embodiment of the injector tip is shown in FIG. 3, illustrating a configuration of a plurality of nozzles and counterbore stages of the injector tip from additional views shown in FIGS. 4-7. Other example embodiments of the multi-nozzle, multi-stage counterbore injector tip are shown in FIGS. 8-16, all adapted to provide similar effects on fuel atomization. The multi-nozzle, multi-stage counterbore injector tip may be used in a routine to deliver fuel to a combustion chamber during engine operation. An example of the routine is illustrated in FIG. 17.

FIGS. 2-16 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

Figure 1:
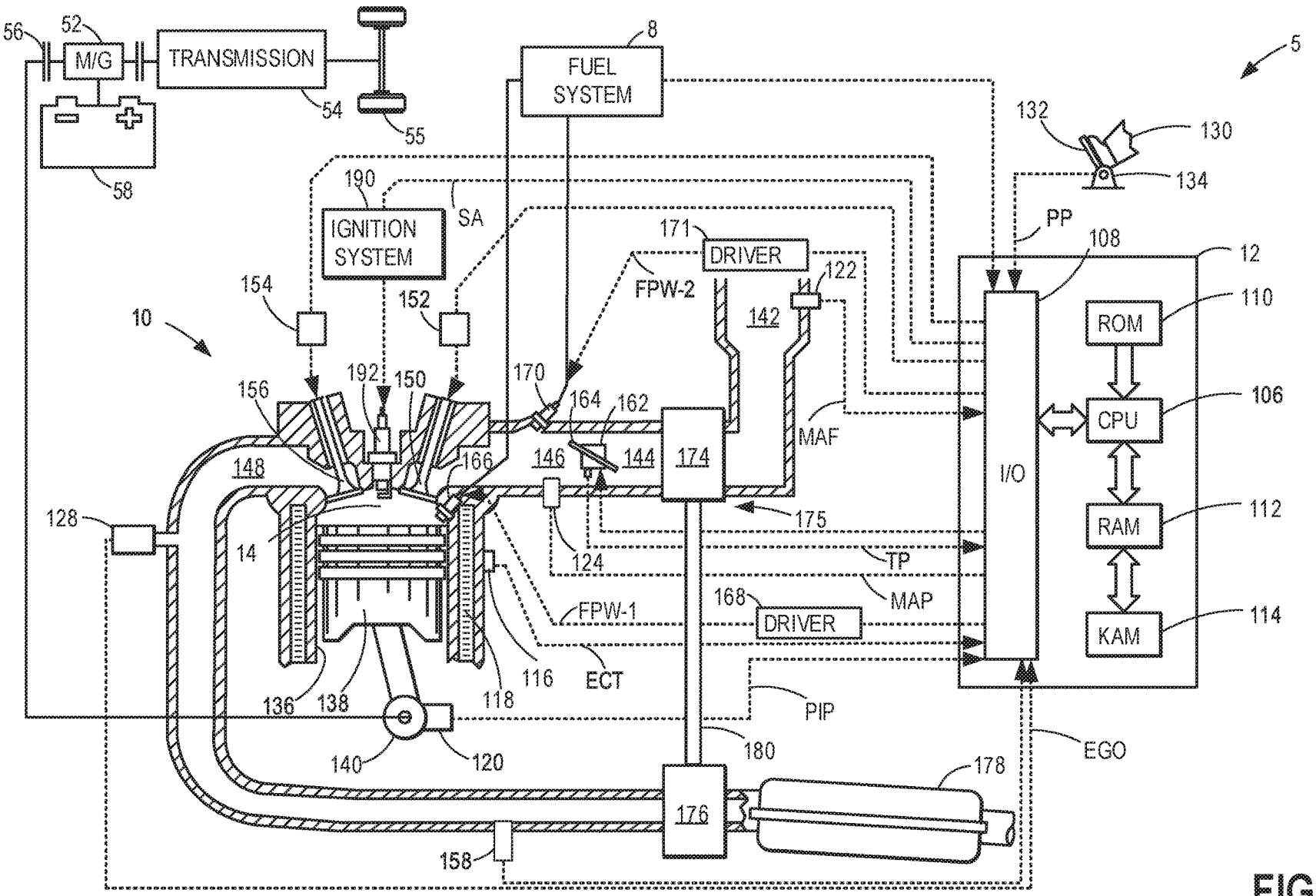
FIG. 1 shows an example of an engine system in which a multi-nozzle injector may be implemented.

Turning now to FIG. 1, an example of a cylinder 14 of an internal combustion engine 10 is illustrated, which may be included in a vehicle 5. Engine 10 may be controlled at least partially by a control system, including a controller 12, and by input from a vehicle operator 130 via an input device 132. In this example, input device 132 includes an accelerator pedal and a pedal position sensor 134 for generating a proportional pedal position signal PP. Cylinder (herein, also "combustion chamber") 14 of engine 10 may include combustion chamber walls 136 with a piston 138 positioned therein. Piston 138 may be coupled to a crankshaft 140 so that reciprocating motion of the piston is translated into rotational motion of the crankshaft. Crankshaft 140 may be coupled to at least one drive wheel 55 of the passenger vehicle via a transmission 54, as described further below. Further, a starter motor (not shown) may be coupled to crankshaft 140 via a flywheel to enable a starting operation of engine 10.

In some examples, vehicle 5 may be a hybrid vehicle with multiple sources of torque available to one or more vehicle wheels 55. In other examples, vehicle 5 is a conventional vehicle with only an engine. In the example shown, vehicle 5 includes engine 10 and an electric machine 52. Electric machine 52 may be a motor or a motor/generator. Crankshaft 140 of engine 10 and electric machine 52 are connected via transmission 54 to vehicle wheels 55 when one or more clutches 56 are engaged. In the depicted example, a first clutch 56 is provided between crankshaft 140 and electric machine 52, and a second clutch 56 is provided between electric machine 52 and transmission 54. Controller 12 may send a signal to an actuator of each clutch 56 to engage or disengage the clutch, so as to connect or disconnect crankshaft 140 from electric machine 52 and the components connected thereto, and/or connect or disconnect electric machine 52 from transmission 54 and the components connected thereto. Transmission 54 may be a gearbox, a planetary gear system, or another type of transmission. The powertrain may be configured in various manners including as a parallel, a series, or a series-parallel hybrid vehicle.

Electric machine 52 receives electrical power from a traction battery 58 to provide torque to vehicle wheels 55. Electric machine 52 may also be operated as a generator to provide electrical power to charge battery 58, for example, during a braking operation.

Cylinder 14 of engine 10 can receive intake air via a series of intake air passages 142, 144, and 146. Intake air passage 146 can communicate with other cylinders of engine 10 in addition to cylinder 14. In some examples, one or more of the intake passages may include a boosting device, such as a turbocharger or a supercharger. For example, FIG. 1 shows engine 10 configured with a turbocharger 175, including a compressor 174 arranged between intake passages 142 and 144 and an exhaust turbine 176 arranged along an exhaust passage 148. Compressor 174 may be at least partially powered by exhaust turbine 176 via a shaft 180 when the boosting device is configured as the turbocharger 175. However, in other examples, such as when engine 10 is provided with a supercharger, compressor 174 may be powered by mechanical input from a motor or the engine and exhaust turbine 176 may be optionally omitted.

A throttle 162 including a throttle plate 164 may be provided in the engine intake passages for varying the flow rate and/or pressure of intake air provided to the engine cylinders. For example, throttle 162 may be positioned downstream of compressor 174, as shown in FIG. 1, or may be alternatively provided upstream of compressor 174.

Exhaust passage 148 can receive exhaust gases from other cylinders of engine 10 in addition to cylinder 14. An exhaust gas sensor 128 is shown coupled to exhaust passage 148 upstream of an emission control device 178. Exhaust gas sensor 128 may be selected from among various suitable sensors for providing an indication of exhaust gas air/fuel ratio (AFR), such as a linear oxygen sensor or UEGO (universal or wide-range exhaust gas oxygen), a two-state oxygen sensor or EGO (as depicted), a HEGO (heated EGO), a NOx, a HC, or a CO sensor, for example. Emission control device 178 may be a three-way catalyst, a NOx trap, various other emission control devices, or combinations thereof.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder. Intake valve 150 may be controlled by controller 12 via an actuator 152. Similarly, exhaust valve 156 may be controlled by controller 12 via an actuator 154. The positions of intake valve 150 and exhaust valve 156 may be determined by respective valve position sensors (not shown).

During some conditions, controller 12 may vary the signals provided to actuators 152 and 154 to control the opening and closing of the respective intake and exhaust valves. The valve actuators may be of an electric valve actuation type, a cam actuation type, or a combination thereof. The intake and exhaust valve timing may be controlled concurrently, or any of a possibility of variable intake cam timing, variable exhaust cam timing, dual independent variable cam timing, or fixed cam timing may be used. Each cam actuation system may include one or more cams and may utilize one or more of cam profile switching (CPS), variable cam timing (VCT), variable valve timing (VVT), and/or variable valve lift (VVL) systems that may be operated by controller 12 to vary valve operation. For example, cylinder 14 may alternatively include an intake valve controlled via electric valve actuation and an exhaust valve controlled via cam actuation, including CPS and/or VCT. In other examples, the intake and exhaust valves may be controlled by a common valve actuator (or actuation system) or a variable valve timing actuator (or actuation system).

Cylinder 14 can have a compression ratio, which is a ratio of volumes when piston 138 is at bottom dead center (BDC) to top dead center (TDC). In one example, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

In some examples, each cylinder of engine 10 may include a spark plug 192 for initiating combustion. An ignition system 190 can provide an ignition spark to combustion chamber 14 via spark plug 192 in response to a spark advance signal SA from controller 12, under select operating modes. A timing of signal SA may be adjusted based on engine operating conditions and driver torque demand. For example, spark may be provided at maximum brake torque (MBT) timing to maximize engine power and efficiency. Controller 12 may input engine operating conditions, including engine speed, engine load, and exhaust gas AFR, into a look-up table and output the corresponding MBT timing for the input engine operating conditions. In other examples, combustion may be initiated via compression of injected fuel (e.g., as in a diesel engine).

In some examples, each cylinder of engine 10 may be configured with one or more fuel injectors for providing fuel thereto. As a non-limiting example, cylinder 14 is shown including a fuel injector 166. Fuel injector 166 may be configured to deliver fuel received from a fuel system 8. Fuel system 8 may include one or more fuel tanks, fuel pumps, and fuel rails. Fuel injector 166 is shown coupled directly to cylinder 14 for injecting fuel directly therein in proportion to the pulse width of a signal FPW-1 received from controller 12 via an electronic driver 168. In this manner, fuel injector 166 provides what is known as direct injection (hereafter also referred to as "DI") of fuel into cylinder 14. While FIG. 1 shows fuel injector 166 positioned to one side of cylinder 14, fuel injector 166 may alternatively be located overhead of the piston, such as near the position of spark plug 192. Such a position may increase mixing and combustion when operating the engine with an alcohol-based fuel due to the lower volatility of some alcohol-based fuels. Alternatively, the injector may be located overhead and near the intake valve to increase mixing. Fuel may be delivered to fuel injector 166 from a fuel tank of fuel system 8 via a high pressure fuel pump and a fuel rail. Further, the fuel tank may have a pressure transducer providing a signal to controller 12.

Fuel injector 166 may have a tip configured to spray fuel into cylinder 14 where the fuel vaporizes and mixes with air. To enable a length and a diameter of the injector tip to be reduced, which may circumvent loss of pressure along the tip and decrease a droplet size of the spray, the injector tip may include a plurality of nozzles. The plurality of nozzles, defining flow paths through the injector tip, may be narrow passages with a geometry that provides a desired effect on fuel flow. For example, the plurality of nozzles may include a central nozzle that leverages a Venturi effect to increase cavitation, thereby enhancing atomization of fuel. Peripheral nozzles may be included in the plurality of nozzles, surrounding the central nozzle, with non-linear shapes that drive swirling of flow. The injector tip may be also be adapted with a multi-stage counterbore having a set of stages arranged in series with a diameter of the counterbore increasing with each sequential stage. The multi-stage counterbore may promote fuel flow away from outlets of the plurality of nozzles, reducing a likelihood of coking that may otherwise increase when the length of the tip is shortened. Further details of the injector tip are described further below with reference to FIGS. 2-16.

Fuel injector 170 is shown arranged in intake passage 146, rather than in cylinder 14, in a configuration that provides what is known as port fuel injection (hereafter referred to as "PFI") into the intake port upstream of cylinder 14. Fuel injector 170 may inject fuel, received from fuel system 8, in proportion to the pulse width of signal FPW-2 received from controller 12 via electronic driver 171. Note that a single driver 168 or 171 may be used for both fuel injection systems, or multiple drivers, for example driver 168 for fuel injector 166 and driver 171 for fuel injector 170, may be used, as depicted.

In an alternate example, each of fuel injectors 166 and 170 may be configured as direct fuel injectors for injecting fuel directly into cylinder 14. In still another example, each of fuel injectors 166 and 170 may be configured as port fuel injectors for injecting fuel upstream of intake valve 150. In yet other examples, cylinder 14 may include only a single fuel injector that is configured to receive different fuels from the fuel systems in varying relative amounts as a fuel mixture, and is further configured to inject this fuel mixture either directly into the cylinder as a direct fuel injector or upstream of the intake valves as a port fuel injector.

Fuel may be delivered by both injectors to the cylinder during a single cycle of the cylinder. For example, each injector may deliver a portion of a total fuel injection that is combusted in cylinder 14. Further, the distribution and/or relative amount of fuel delivered from each injector may vary with operating conditions, such as engine load, knock, and exhaust temperature, such as described herein below. The port injected fuel may be delivered during an open intake valve event, closed intake valve event (e.g., substantially before the intake stroke), as well as during both open and closed intake valve operation. Similarly, directly injected fuel may be delivered during an intake stroke, as well as partly during a previous exhaust stroke, during the intake stroke, and partly during the compression stroke, for example. As such, even for a single combustion event, injected fuel may be injected at different timings from the port and direct injector. Furthermore, for a single combustion event, multiple injections of the delivered fuel may be performed per cycle. The multiple injections may be performed during the compression stroke, intake stroke, or any appropriate combination thereof.

Fuel injectors 166 and 170 may have different characteristics. These include differences in size, for example, one injector may have a larger injection hole than the other. Other differences include, but are not limited to, different spray angles, different operating temperatures, different targeting, different injection timing, different spray characteristics, different locations etc. Moreover, depending on the distribution ratio of injected fuel among injectors 170 and 166, different effects may be achieved.

Fuel tanks in fuel system 8 may hold fuels of different fuel types, such as fuels with different fuel qualities and different fuel compositions. The differences may include different alcohol content, different water content, different octane, different heats of vaporization, different fuel blends, and/or combinations thereof etc. One example of fuels with different heats of vaporization could include gasoline as a first fuel type with a lower heat of vaporization and ethanol as a second fuel type with a greater heat of vaporization. In another example, the engine may use gasoline as a first fuel type and an alcohol containing fuel blend such as E85 (which is approximately 85% ethanol and 15% gasoline) or M85 (which is approximately 85% methanol and 15% gasoline) as a second fuel type. Other feasible substances include water, methanol, a mixture of alcohol and water, a mixture of water and methanol, a mixture of alcohols, etc.

Controller 12 is shown in FIG. 1 as a microcomputer, including a microprocessor unit 106, input/output ports 108, an electronic storage medium for executable programs (e.g., executable instructions) and calibration values shown as non-transitory read-only memory chip 110 in this particular example, random access memory 112, keep alive memory 114, and a data bus. Controller 12 may receive various signals from sensors coupled to engine 10, including signals previously discussed and additionally including a measurement of inducted mass air flow (MAF) from a mass air flow sensor 122; an engine coolant temperature (ECT) from a temperature sensor 116 coupled to a cooling sleeve 118; an exhaust gas temperature from a temperature sensor 158 coupled to exhaust passage 148; a profile ignition pickup signal (PIP) from a Hall effect sensor 120 (or other type) coupled to crankshaft 140; throttle position (TP) from a throttle position sensor; signal EGO from exhaust gas sensor 128, which may be used by controller 12 to determine the AFR of the exhaust gas; and an absolute manifold pressure signal (MAP) from a MAP sensor 124. An engine speed signal, RPM, may be generated by controller 12 from signal PIP. The manifold pressure signal MAP from MAP sensor 124 may be used to provide an indication of vacuum or pressure in the intake manifold. Controller 12 may infer an engine temperature based on the engine coolant temperature and infer a temperature of catalyst 178 based on the signal received from temperature sensor 158. Controller 12 receives signals from the various sensors of FIG. 1 and employs the various actuators of FIG. 1 to adjust engine operation based on the received signals and instructions stored on a memory of the controller.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

FIG. 2 shows a schematic diagram of an example fuel injector 200 which may be used to supply fuel from a fuel system to an engine, e.g., fuel system 8 and engine 10 of FIG. 1. Fuel injector 200 may be a direct injector, e.g., fuel injector 200 is a non-limiting example of injector 166 of FIG. 1. Accordingly, fuel injector 200 is configured to be positioned in a cylinder of an engine and deliver fuel to the cylinder via a plurality of injector nozzles, as described below. However, in some examples, fuel injector 200 may be a port fuel injector.

Fuel injector 200 includes a nozzle body 202 which may be used as valve seat support and part of a valve housing. A valve mechanism 203 within nozzle body 202 is displaceable in an axial direction, e.g., along a central axis 255 of fuel injector 200. Valve mechanism 203 may be a pintle or needle which is slideable in a direction of central axis 255, for example.

Fuel injector 200 may be an inwardly opening fuel injector, which has a plurality of nozzles 230 (e.g., orifices) formed in valve seat body 205 so that when an injector driver circuit 211 is activated to actuate valve mechanism 203, valve mechanism 203 lifts off from the valve seat body 205 to create a gap between a valve closure member 204 and a valve seat surface 206 so that fuel may flow out of the nozzles 230.

Valve mechanism 203 is coupled to the valve closure member 204, which cooperates with the valve seat surface 206 formed on valve seat body 205 to form a sealing seat. Valve seat body 205 may be fixedly coupled to a downstream end 256 of nozzle body 202. However, valve seat surface 206 may also be formed directly on a base part of nozzle body 202. For example, valve closure member 204 may be ball-shaped or frustoconical-shaped so that in a closed position, valve closure member 204 engages with valve seat surface 206 to shut off fuel flow through the fuel injector via nozzles 230 in the downstream end 256 of the fuel injector.

In some examples, valve mechanism 203 may penetrate an armature 220 in an inner opening in an upstream valve housing 237. Armature 220 may be coupled to valve mechanism 203 so as to be axially displaceable along a direction of central axis 255. An upwards movement of armature 220 along the central axis 255 may be halted by a first, upper flange 221, which may be integrally formed with an upstream portion of valve mechanism 203, and a downwards movement of armature 220 along the central axis 255 may be halted by a second, lower flange 222, which is coupled to valve mechanism 203 downstream of armature 220. Braced on first flange 221 is a restoring spring 223 which biases the valve mechanism 203 in a closed position against the valve seat body 205. Restoring spring 223 may be pre-stressed by an adjustment sleeve 224.

Upstream valve housing 237 includes an injector driver 211 which actuates the valve mechanism in response to a start of injection (SOI) event. The injector driver 211 may include an electromagnetic actuator for actuating the valve mechanism 203 and may include a magnetic coil 210 wound onto a coil brace 212, which rests against a connection piece 213 acting as inner pole 233. Current may be supplied in magnetic coil 210 in two opposite directions and at varying amounts depending on operating conditions. In an outward direction from central axis 255, the magnetic circuit may be sealed by an outer magnetic component 214. Magnetic coil 210 is energized via a line 219 by an electric current that may be supplied via an electric plug contact 217.

The fuel is supplied via a central fuel supply 216, or inlet 216, at an upstream end 259 of fuel injector 200 and filtered by a filter element 225 inserted therein. Fuel injector 200 may be sealed from a fuel distributor line, e.g., a fuel rail, by a seal 228 and from a cylinder head, e.g., cylinder 30, by another seal 236.

In particular, fuel injector 200 may receive fuel pulse width signal FPW from controller 12 to control fuel injection. Signal FPW governs fuel injection by energizing electromagnetic actuator coil 210 to initiate the start of injection (SOI) of fuel from fuel injector 200. Additionally, FPW may dictate the end of injection (EOI) of fuel from fuel injector 200. In particular, during fuel injection, pressurized fuel may be supplied from a fuel rail to fuel injector 200 via inlet 216, the flow of which is governed by the electromagnetic actuator having coil 210, coupled to valve mechanism 203 which lifts from valve seat body 205 to spray fuel into a cylinder, such as cylinder 14 of FIG. 1.

In operation, restoring spring 223 acts upon first flange 221 of valve mechanism 203 to counter to its lift direction, so that valve closure member 204 is retained in sealing contact against valve seat surface 206. Excitation of magnetic coil 210 may be performed by supplying a first amount of current in a first direction through magnetic coil 210. The first amount of current in the first direction generates a magnetic field which attracts valve mechanism 203 upwards to lift valve mechanism 203 off of valve seat body 205. For example, the magnetic field may move magnetic armature 220 in the lift direction, e.g., upwards along the central axis 255, to counter the spring force of restoring spring 223. The overall lift of the valve mechanism may be defined by a working gap existing between connection piece 213 and magnetic armature 220 in the rest position. Magnetic armature 220 carries along first flange 221 in the lift direction as well. Valve closure member 204, which is connected to valve mechanism 203, lifts off from valve seat surface 206 and the fuel is spray-discharged through the plurality of nozzles 230.

In response to an EOI event, the first amount of current supplied to injector driver 211 in the first direction is discontinued, and following sufficient decay of the magnetic field, magnetic armature 220 drops away from connection piece 213 due to the pressure of restoring spring 223, so that valve mechanism 203 moves counter to the lift direction. Valve closure member 204 sets down on valve seat surface 206, and fuel injector 200 is closed again.

The above-described valve actuation mechanism is non-limiting, and fuel injector 200 may be opened and closed according to other suitable mechanisms without departing from the scope of this disclosure.

The downstream end 256 of fuel injector 200 may have a tip 232 that includes the plurality of nozzles 230 and a multi-stage counterbore 234. The multi-stage counterbore 234 may couple directly to outlets of each of the plurality of nozzles 230 as well as an outer surface 236 of the valve seat body 205. In some examples, the multistage-stage counterbore 234 may be continuous with the valve seat body 205, e.g., seamlessly integrated with the valve seat body 205. In other examples, the multi-stage counterbore 234 may be permanently attached to the valve seat body, e.g., by welding, or removably connected by a mechanism such as threaded surfaces. Regardless of the method of attachment, the multi-stage counterbore 234 is arranged downstream of the plurality of nozzles 230 so that fuel exiting the plurality of nozzles 230 continues flowing through the multi-stage counterbore 234 uninterrupted. A combination of the plurality of nozzles 230 and the multi-stage counterbore 234 may enable the tip 232 to increase atomization of fuel delivered to the combustion chamber.

A first embodiment 302 of a multi-nozzle, multi-stage counterbore injector tip 304 is shown in FIGS. 3-7 in a first perspective view 300, a second perspective view 400, a profile view 500, a first cross-section 600, and a second cross-section 700, respectively. The injector tip 304 has a central axis 301 and a set of reference axes 399 are provided for comparison between views, indicating a y-axis, an x-axis, and a z-axis. In some examples, the injector tip 304 may be implemented in the injector 166 of FIG. 1 and 200 of FIG. 2, integrated with a valve seat body at a downstream end of the injector, e.g., the valve seat body 205 of FIG. 2.

Figure 4:
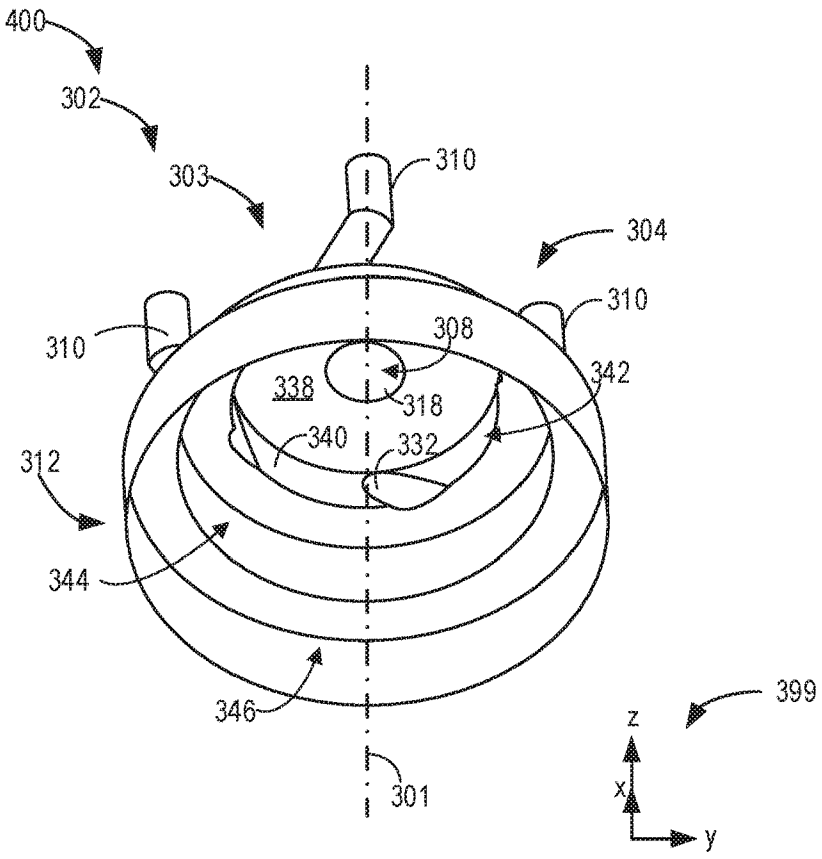
FIG. 4 shows a second perspective view of the first embodiment of the multi-nozzle injector tip.
Figure 6:
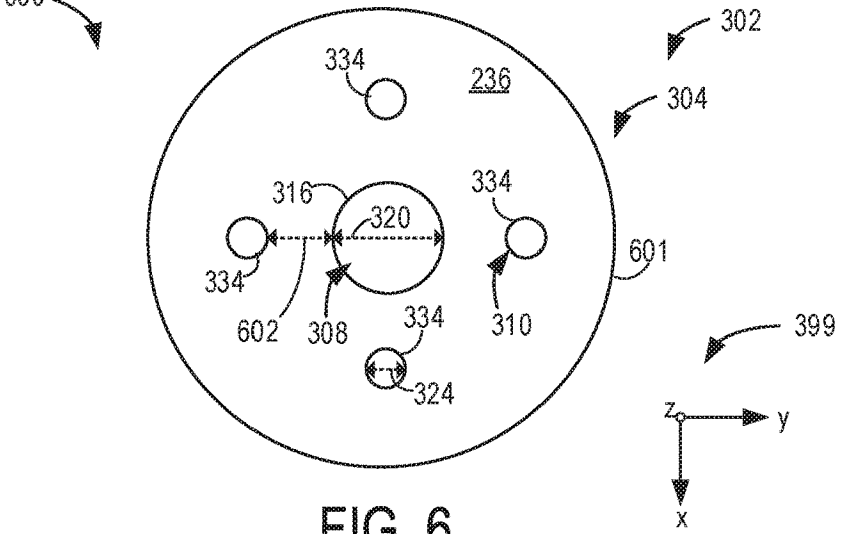
FIG. 6 shows a first cross-section of the first embodiment of the multi-nozzle injector tip.
Figure 7:
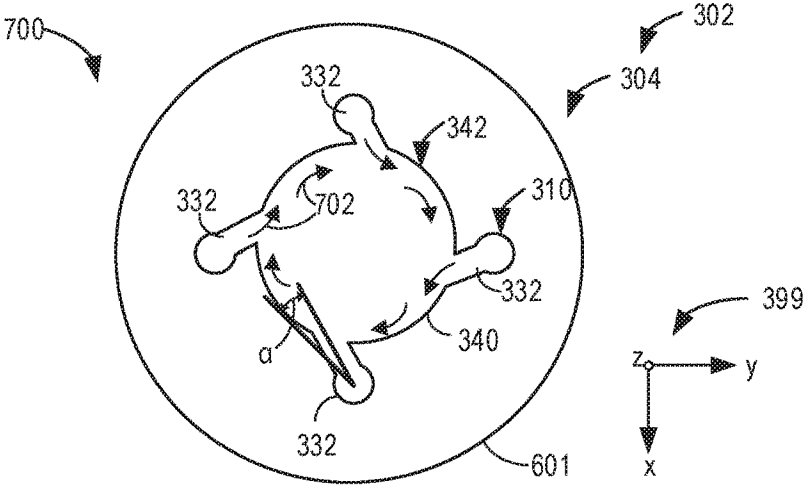
FIG. 7 shows a second cross-section of the first embodiment of the multi-nozzle injector tip.
Figure 5:
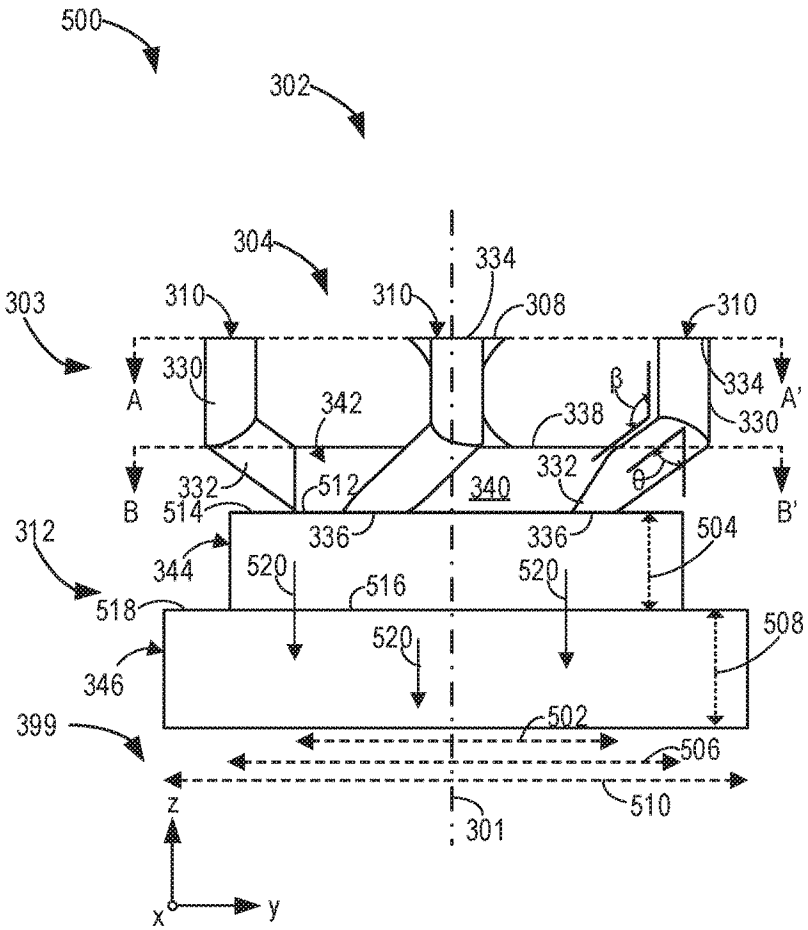
FIG. 5 shows a profile view of the first embodiment of the multi-nozzle injector tip.

The injector tip 304 may be surrounded by a circular injector body 601, as shown in FIGS. 6 and 7, that may couple to a counterbore 312 of the injector tip 304, the counterbore 312 shown in FIGS. 3-5. A diameter of the injector tip 304, the diameter perpendicular to the central axis 301, may vary along a length 306, as shown in FIG. 3, of the injector tip 304. The injector tip 304 has a plurality of nozzles 303, including a primary nozzle 308 and secondary nozzles 310, as well as the counterbore 312 coupled to the plurality of nozzles 303. The plurality of nozzles 303 may be passages, e.g., elongate orifices, extending through a material of the valve seat body of the injector. The primary nozzle 308 is arranged along the central axis 301 and the secondary nozzles 310 are arranged off-axis, around the primary nozzle 308, each of the secondary nozzles 310 spaced away from the primary nozzle 308 by a uniform radius 602, the radius 602 shown in the first cross-section 600 of FIG. 6. The secondary nozzles 310 may also be uniformly spaced apart from one another around the primary nozzle 308.

The primary nozzle 308 may be shaped to impose a Venturi effect that drives flow through the primary nozzle 308 by aspiration. The primary nozzle 308 has an inlet 316 and an outlet 318 with a similar diameter 320. A central portion 322 of the primary nozzle 308, between the inlet 316 and the outlet 318 along the central axis 301, may have a narrower diameter 324, e.g., a throat, forming a flow constriction through the primary nozzle 308. The flow constriction produces the Venturi effect on the fuel flow, where a flow velocity through the central portion 322 of the primary nozzle 308 increases relative to the inlet 316, resulting in a drop in pressure in the central portion 322. The lower pressure in the central portion draws fuel through the primary nozzle 308 and the increased flow velocity generates high turbulence that decreases a droplet size of the fuel emerging from the outlet 318 of the primary nozzle 308.

Fuel may also flow through the secondary nozzles 310 of the plurality of nozzles 303. Each of the secondary nozzles 310 may be similarly configured. It will be appreciated that while four nozzles of the secondary nozzles 310 are shown, other examples may include more or less than four nozzles without departing from the scope of the present disclosure. The secondary nozzles 310 may have a diameter 326 that is wider than the diameter 324 of the central portion 322 of the primary nozzle 308 and narrower than the diameter 320 of the inlet 316 of the primary nozzle 308. For example, the diameter 320 of the inlet 316 and outlet 318 of the primary nozzle 308 may be 0.15 mm. The diameter 324 of the central portion 322 of the primary nozzle 308 may be 0.06 mm, narrower than the inlet 316 and the outlet 318 by 60%. The diameter 326 of each of the secondary nozzles 310 may be 0.08 mm.

In other examples, however, the diameter 324 of the secondary nozzles 310 may be similar to the diameter 320 of the inlet 316 of the primary nozzle 308 or similar to the diameter 324 of the central portion 322 of the primary nozzle 308. In yet other examples, the diameter 324 of the secondary nozzles 310 may be wider than the inlet 316 of the primary nozzle 308 or narrower than the central portion 322 of the primary nozzle 308.

The diameter 326 of each of the secondary nozzles 310 may remain relatively uniform along an overall length 328 of each of the secondary nozzles 310. The secondary nozzles 310 are not parallel with the central axis 301 along the entire length 328 of each of the secondary nozzles 310. Instead, each of the secondary nozzles 310 may be formed of a first segment 330 and a second segment 332, the two segments continuous with one another and intersecting at a joint 314 of each of the secondary nozzles 310. The first segment 330 of the secondary nozzles 310 may be parallel with the z-axis but the second segment 332 may be inclined or angled relative to the z-axis. Both the first segment 330 and the second segment 332 of the secondary nozzles 310 may be cylindrical in shape.

The overall length 328 of each of the secondary nozzles 310 is divided between the first segment 330 and the second segment 332. In one example, the first segment 330 may be 0.16 mm long, forming 62% of the overall length 328 and the second segment 332 may be 0.1 mm long, forming 38% of the overall length 328 of the secondary nozzles. In other examples, however, the length of the second segment 332 may be equal to the length of the first segment 330 or the second segment 332 may be longer than the first segment. In addition an extension 305 of the secondary nozzles 310 along the z-axis, e.g., a distance between an upstream end 334 to a downstream end 336 of each of the secondary nozzles 310, may be equal to a sum of a height 307 of the primary nozzle 308 and a height 309 of a first stage 342 of the counterbore 312. As an example, the height 307 of the primary nozzle 308 may be 0.15 mm, the height 309 of the first stage 342 may be 0.1 mm, and the extension 305 of the plurality of secondary nozzles 310 may be 0.25 mm. As such, the upstream end 334 of each of the secondary nozzles 310 are co-planar with the inlet 316 of the primary nozzle 308, e.g., the upstream end 334 of each of the secondary nozzles 310 and the inlet 316 of the primary nozzle 308 share a common x-y plane, as shown in FIG. 5.

In addition to the z-axis, the second segment 332 of the secondary nozzles 310 may also be angled relative to the x-axis and the y-axis. An alignment of the second segment 332 is shown in the profile view 500 of FIG. 5. In FIG. 5, as the second segment 332 extends along the z-axis, the second segment 332 forms an angle θ which may be 60 degrees, for example. An angle β between the first segment 330 and the second segment 332 may be 120 degrees. The second segment 332 is similarly not aligned with the x-axis or y-axis, as shown in the second cross-section 700 of FIG. 7 taken along line B-B' indicated in FIG. 5. In FIG. 7, each second segment 332 of the secondary nozzles 310 may form an angle α relative to a tangential line of a side wall 340 of the first stage 342 of the counterbore 312. The angle α may be 30 degrees, for example.

The orientation of the second segment 332 of the secondary nozzles 310 may result in rotation of fuel flowing therethrough. For example, as fuel travels from the upstream end 334 to the downstream end 336 of the secondary nozzles 310, as shown in FIG. 5, the second segment 332 of each of the secondary nozzles 310 may rotate the flow in a counterclockwise direction, when viewed from above along the central axis 301. The direction of fuel flow effected by the secondary nozzles 310 is depicted by arrows 702 in FIG. 7. In examples where the second segment 332 of the secondary nozzles 310 is oriented in an opposite direction from the secondary nozzles shown in FIGS. 3-7, fuel flowing through the secondary nozzles 310 may be directed along a clockwise direction.

As the fuel emerges from the downstream end 336 of each of the secondary nozzles 310 into an inner volume of the first stage 342 of the counterbore 312, the fuel may interact with fuel emerging from the outlet 318 of the primary nozzle 308. The fuel channeled through the primary nozzle 308 may flow into the inner volume of the first stage 342 of the counterbore 312 with high turbulence. The turbulence of the flow from the primary nozzle 308, in combination with the swirling of the fuel flow from the secondary nozzles 310, may result in enhanced cavitation and atomization of the fuel as the two fuel flows mix within the counterbore 312.

The upstream end 334 of each of the secondary nozzles 310 may be openings extending through the valve seat body of the injector, as shown in the first cross-section 600 of FIG. 6. The first cross-section 600 is taken along line A-A' of FIG. 5, along a floor 239 of the valve seat body 205 as shown in FIG. 2. The upstream end 334 of each of the secondary nozzles 310 and the inlet 316 of the primary nozzle 308 form circular apertures in the floor 239 of the valve seat body, fluidly coupling the plurality of nozzles 303 to an injector sac volume. The sac volume may be a volume of space between the valve closure member 204 and the surface 206 and the floor 239 of the valve seat body 205 of FIG. 2. When the valve closure member 204 is lifted upwards and away from the valve seat body 205, fuel may flow through the nozzle body 202 of the injector 200, around the valve closure member 204 and through the plurality of nozzles 303.

The fuel exits the plurality of nozzles 303 through the downstream end 336 of each of the secondary nozzles 310 and the outlet 318 of the primary nozzle 308. The outlet 318 of the primary nozzle 308 forms an opening in a top wall 338 of the counterbore 312, as shown in FIGS. 3-5, while the downstream end 336 of each of the secondary nozzles 310 is coupled to a side wall 340 of the first stage 342 of the counterbore 312. As such, the second segment 332 of each of the secondary nozzles 310 extend outwards, away from the central axis 301, from the side wall 340 of the first stage 342 at angle θ relative to the side wall 340 of the first stage 342. Each of the second segment 332 may form an opening in the side wall 340 of the first stage 342, as shown in FIG. 4.

The counterbore 312 has, in addition to the first stage 342, a second stage 344 and a third stage 346. Each stage is hollow and cylindrical, as shown in FIG. 4, and the stages are stacked along the z-axis so that the second stage 344 is above the third stage 346 and the first stage 342 is above the second stage 344. The stages are all centered about the central axis 312 and aligned with the primary nozzle 308 along the z-axis. In other words, a centerpoint of each stage and a centerpoint of the primary nozzle 308 are aligned with the central axis 312. A height of each stage is smaller than a diameter of each stage. Furthermore a diameter of each stage increases along a downstream direction indicated by arrows 520 in FIG. 5, e.g., away from the plurality of nozzles 303, along the central axis 301, forming a stepped structure of the counterbore 312. For example, the height 307 of first stage 342 may be 0.1 mm, as shown in FIG. 3, and a diameter 502 of the first stage may be 0.5 mm, as shown in FIG. 5. FIG. 5 also shows that the second stage 344 may have a height 504 of 0.15 mm and a diameter 506 of 0.7 mm. The third stage 346 may have a height 508 of 0.18 mm and a diameter 510 of 0.9 mm.

Each stage has a top wall but not a bottom wall, e.g., each stage has an open end and the stages may share a common inner volume. Each stage, with the exception of the third stage 326, may be coupled to a top wall of the stage below. For example, as shown in FIG. 5, the first stage 342 may be coupled at a bottom end 512 to a top wall 514 of the second stage 344. The top wall 514 of the second stage 344 may have an opening with a diameter equal to the diameter 502 of the first stage 342. Similarly, a bottom end 516 of the second stage 344 may be coupled to a top wall 518 of the third stage 346. The top wall 518 of the third stage 346 may have an opening with a diameter equal to the diameter 506 of the second stage 344. The counterbore 312 may be formed, e.g., manufactured, as a single continuous unit so that the stages are coupled to one another seamlessly. Alternatively, the stages may be formed individually and subsequently coupled by, for example, welding.

Fuel flowing through the set of nozzles 303 may flow into an inner volume of the counterbore 312, e.g., a space inside of the stages of the counterbore 312, along a direction indicated by arrows 520 in FIG. 5. A geometry of the counterbore 312, increasing in diameter downwards along the central axis 301, encourages flow of fuel away from the outlet 318 of the primary nozzle 308 and the downstream end 336 of each of the secondary nozzles 310. By directing flow along the direction indicated by arrows 520, backflow of fuel towards the set of nozzles 303 is decreased and a likelihood of coking upon exposure of the fuel spray to high temperatures of the combustion chamber is reduced. Furthermore, the counterbore 312 may provide structural integrity to the injector tip 304, enabling the injector tip 304 to withstand high fuel pressures. Additionally, reducing coking enables a desired air-to-fuel-ratio at the combustion chamber, maintaining fuel efficiency of the engine and increasing a performance of the engine.

Figure 8:
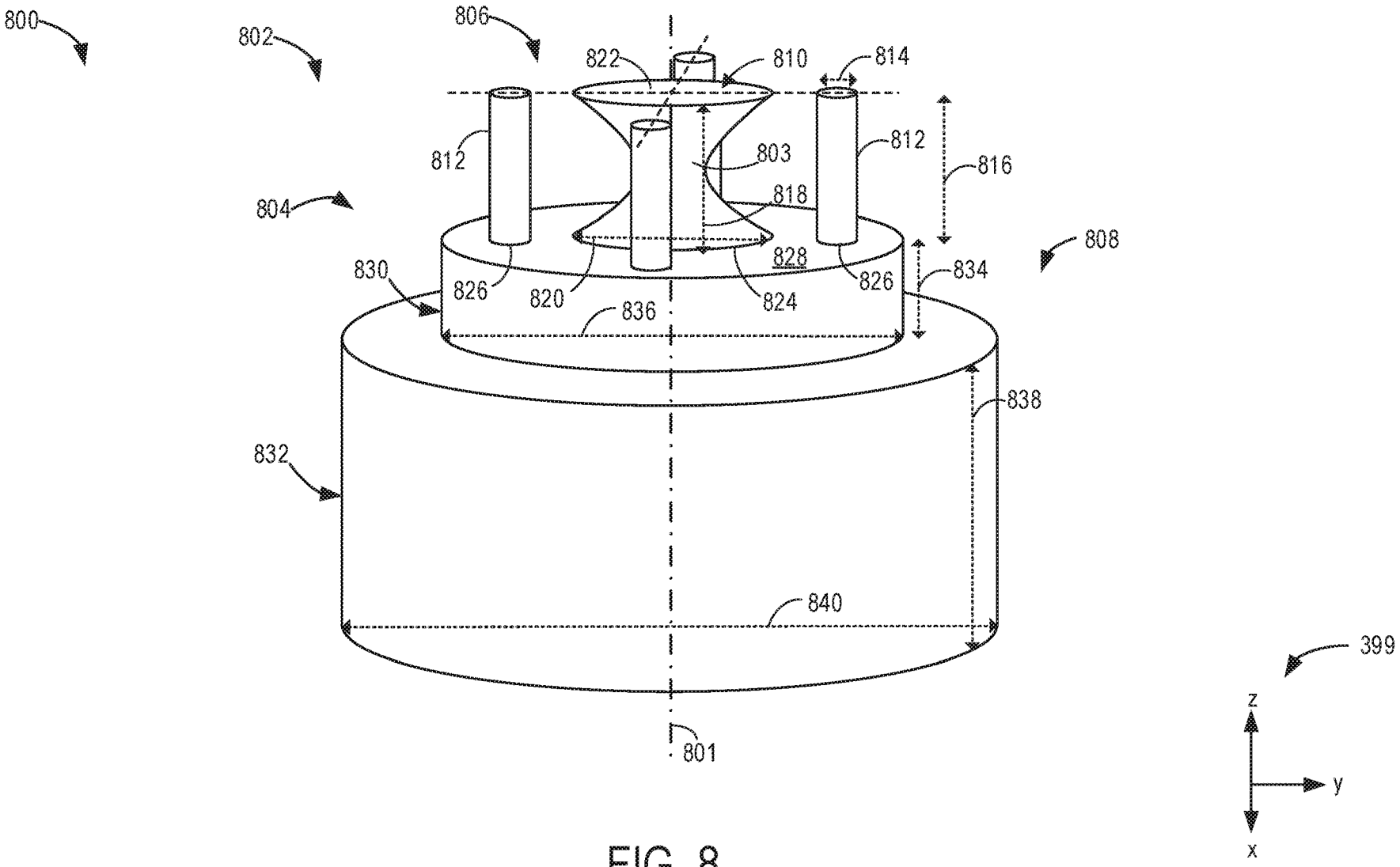
FIG. 8 shows a perspective view of a second embodiment of a multi-nozzle injector tip.

A second embodiment 802 of an injector tip 804 is shown in FIG. 8 from a perspective view 800. The second embodiment 802 of the injector tip 804 may be a simplified example of the first embodiment 302 of the injector tip 304 of FIGS. 3-7. The injector tip 804 of FIG. 8 may have a set of nozzles 806 arranged above a counterbore 808 along a central axis 801 of the injector tip 804. The set of nozzles 806 includes a primary nozzle 810, similar to the primary nozzle 308 of FIGS. 3-7, adapted with a reduction in diameter at a central portion 803 of the primary nozzle 810 to create a Venturi effect on fuel flow therethrough.

The set of nozzles 806 also includes secondary nozzles 812, uniformly spaced away from the primary nozzle 810 and surrounding the primary nozzle 810. The secondary nozzles 812 may be uniformly spaced away from one another and may each be a cylindrical passage extending linearly along the z-axis. As such, each of the secondary nozzles 812 is formed of a single segment instead of two segments, e.g., such as the secondary nozzles 310 of FIGS. 3-7. The secondary nozzles 812 may each have a diameter 814 that is uniform along a length 816 of each of the secondary nozzles 812. The length 816 of the secondary nozzles 812 may be equal to a height 818 of the primary nozzle 810 but the diameter 814 of the secondary nozzles 812 may be narrower than each of a diameter 820 of an inlet 822 and a diameter of an outlet 824 of the primary nozzle 810. The diameter 814 of the secondary nozzles 812 may be similar to or different from a diameter of the central portion 803 of the primary nozzle 810.

The outlet 824 of the primary nozzle 810 and downstream ends 826 of the secondary nozzles 812 may all form openings in a top wall 828 of a first stage 830 of the counterbore 808. The counterbore 808 may be formed of the first stage 830 stacked above a second stage 832, the first stage 830 having a smaller height 834 and a smaller diameter 836 than a height 838 and a diameter 840 of the second stage 832. Unlike the counterbore 312 of the injector tip 304 of FIGS. 3-7, the counterbore 808 of the injector tip 804 of FIG. 8 does not have a third stage.

Forming the injector tip 804 with linearly arranged secondary nozzles 812 and two stages of the counterbore 808 instead of three, may simplify manufacturing of the injector tip 804, thereby reducing costs. However, the straight secondary nozzles 812 do not impart rotation of fuel flow as the fuel enters an inner volume of the counterbore 808 and mixes with the turbulent flow from the primary nozzle 810. Cavitation of fuel droplets may therefore be lower in the second embodiment 802 of FIG. 8 than the first embodiment 302 of FIGS. 3-7 and the second embodiment 802 of the injector tip 804 may be implemented when fuel pressure in an injector body is high and less cavitation is demanded to effect a desired level of atomization is demanded. The set of nozzles 806 may have larger diameters that provide a lesser degree of fuel atomization than the first embodiment 302, the set of nozzles 806 occupying a greater volume of space and precluding incorporation of a third stage in the counterbore 808.

Figure 11:
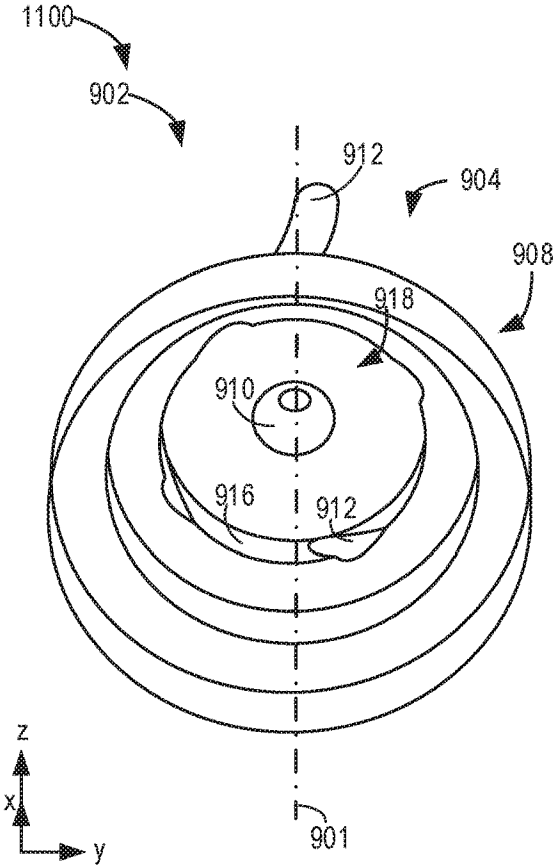
FIG. 11 shows a second perspective view of the third embodiment of the multi-nozzle injector tip.
Figure 10:
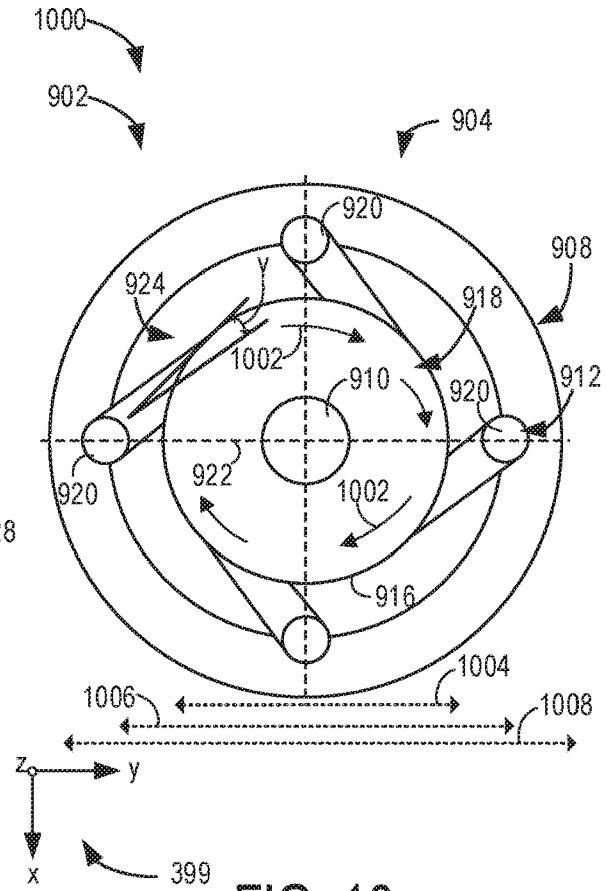
FIG. 10 shows a top view of the third embodiment of the multi-nozzle injector tip.
Figure 9:
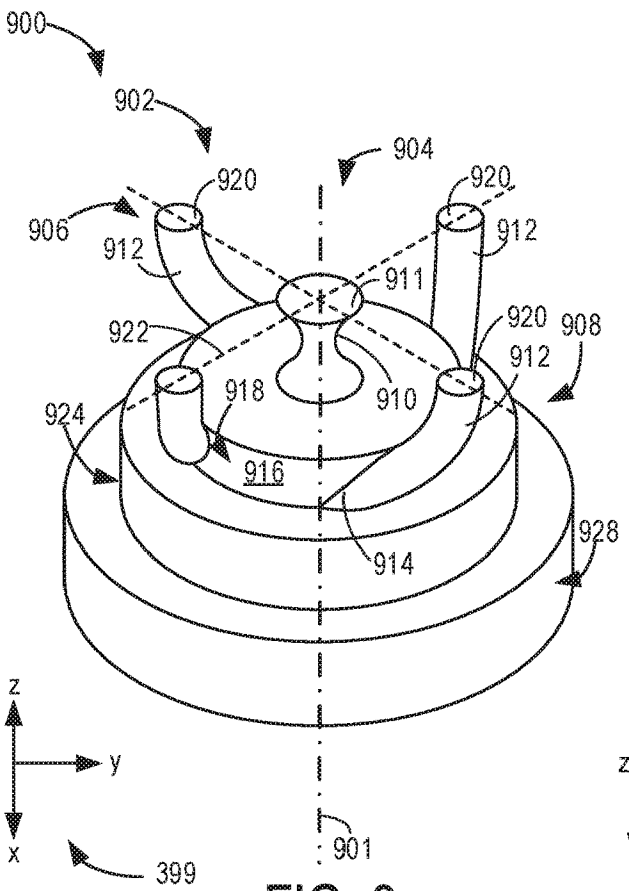
FIG. 9 shows a first perspective view of a third embodiment of a multi-nozzle injector tip.

A third embodiment 902 of an injector tip 904 is shown in FIGS. 9-11 from a first perspective view 900, a top view 1000, and a second perspective view 1100, respectively. The injector tip 904 may have similar dimensions to the first embodiment 302 of the injector tip 304 of FIGS. 3-7 and be similarly adapted with a set of nozzles 906 arranged above and coupled to a counterbore 908 along a central axis 901 of the injector tip 904, as shown in FIG. 9. The set of nozzles 906 includes a primary nozzle 910 that is similar to the primary nozzle 308 of FIGS. 3-7, adapted to impart an Venturi effect on fuel flow therethrough and centered about the central axis 901, as well as secondary nozzles 912, surrounding and spaced away from the primary nozzle 308.

Each of the secondary nozzles 912 may form openings, as shown in FIG. 11, in a side wall 916 of a first stage 918 of the counterbore 908 at a downstream end 914 of the secondary nozzles 912. The secondary nozzles 912 may be curved with respect to each of the z-, x-, and y-axes, extending upwards along the central axis 901 and outwards away from the side wall 916 of the first stage 918. The secondary nozzles 912 may each be formed of a single segment that curves in a clockwise direction from an upstream end 920 of each of the secondary nozzles 912 to the downstream end 914, when viewed from above, as shown in FIG. 10. The upstream end 920 of each of the secondary nozzles 912 and an inlet 911 of the primary nozzle 910 are co-planar with a plane 922.

FIG. 10 shows a top view 1000 of the injector tip 904. A center line of each of the secondary nozzles may form an angle γ with a line tangent to the side wall 916 of the first stage 918. The angle γ may be between 10-30 degrees and may swirl fuel in a direction indicated by arrows 1002 as fuel flows into an inner volume of the first stage 918 of the counterbore 908, mixing with turbulent fuel flow emerging from the primary nozzle 910.

The counterbore 908 may affect fuel flow within an inner volume of the counterbore 908 in a similar manner as the counterbore 312 of FIGS. 3-7. The counterbore 908, in addition to the first stage 918, includes a second stage 924 that has a larger diameter 1004 than a diameter 1006 of the first stage 918, and a third stage 926 with a larger diameter 1008 than the second stage 924, the diameters shown in FIG. 10. The stages are stacked along the central axis 901, with the first stage 918 above the second stage 924 and the second stage above the third stage 926, the stages either formed as a continuous unit or separate units that are coupled via a method such as welding. Heights of each of the stages, measured along the z-axis, may be similar or different from one another.

The injector tip 904 of FIGS. 9-11 may increase atomization of fuel by swirling the fuel flow through the secondary nozzles 912 and generating turbulent flow through the primary nozzle 910 and directing the atomized fuel out of the inner volume of the counterbore 908 as compelled by a geometry of the counterbore 908. The curved secondary nozzles 912, however, may provide greater swirling of fuel flow due to less friction experience by the fuel in the curved secondary nozzles 912 than the jointed secondary nozzles 310 of FIGS. 3-7. Thus, the third embodiment 902 of the injector tip 904 may be used when fuel pressure in an injector body coupled to the injector tip 904 is anticipated to be low. The third embodiment may be a preferred configuration for providing high spray atomization and less spray penetration as well as reduced coking enable by the first stage 918 of the counterbore 908.

Figure 14:
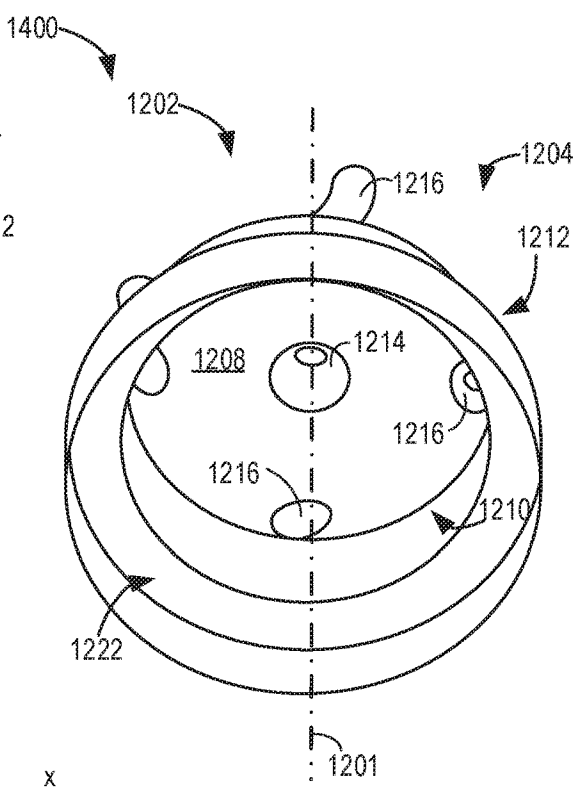
FIG. 14 shows a second perspective view of the fourth embodiment of the multi-nozzle injector tip.
Figure 13:
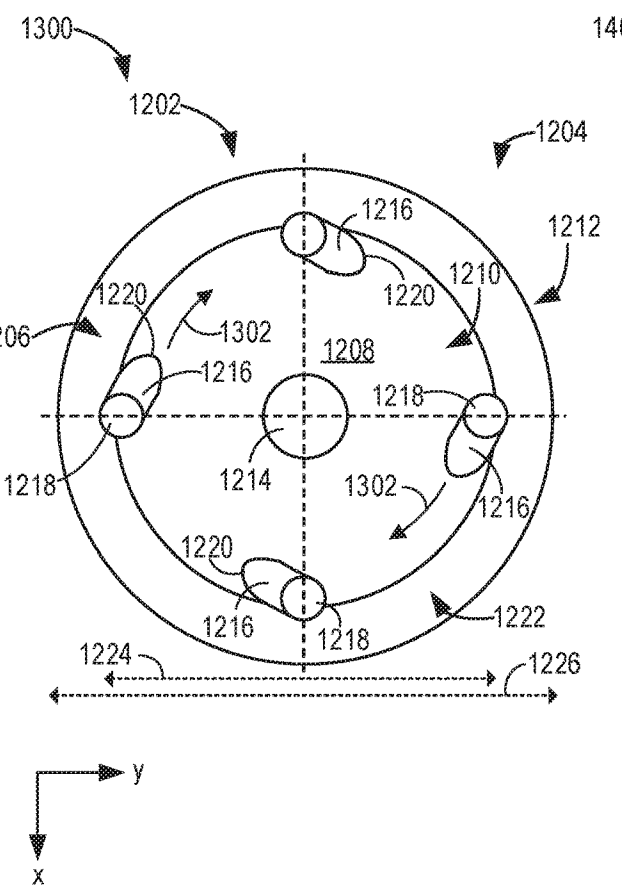
FIG. 13 shows a top view of the fourth embodiment of the multi-nozzle injector tip.
Figure 12:
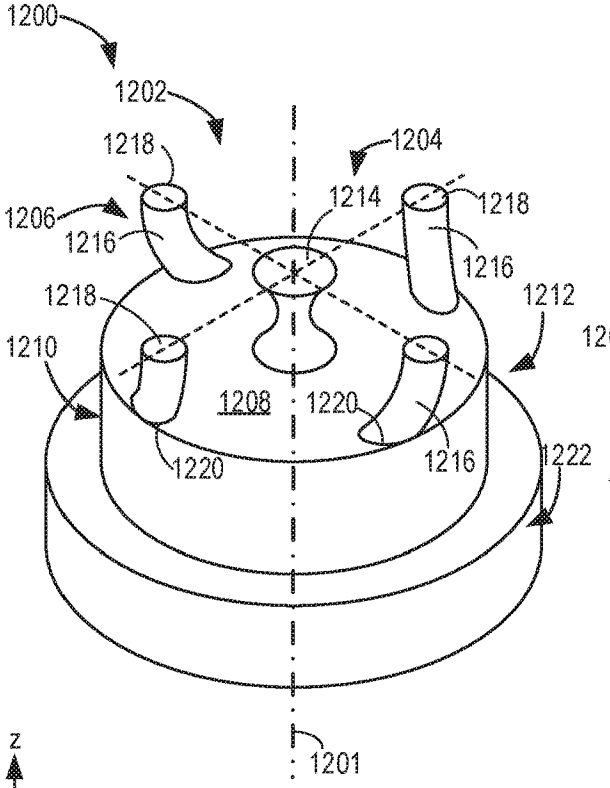
FIG. 12 shows a first perspective view of a fourth embodiment of a multi-nozzle injector tip.

A fourth embodiment 1202 of an injector tip 1204 is shown in FIGS. 12-14, depicting a first perspective view 1200, a top view 1300, and a second perspective view 1400, respectively. The injector tip 1204 has a set of nozzles 1206 protruding upwards, along the z-axis, from a top wall 1208 of a first stage 1210 of a counterbore 1212 of the injector tip 1204. The set of nozzles 1206 forms openings in the top wall 1208 of the first stage 1210, as shown in FIG. 14, and includes a centrally, e.g., aligned with a central axis 1201 of the injector tip 1204, disposed primary nozzle 1214 surrounded by secondary nozzles 1216 that are uniformly spaced away from the primary nozzle 1214 and from one another. The primary nozzle 1214 may have a central region reduced in diameter to create a Venturi effect on fuel flowing therethrough. The secondary nozzles 1216, while extending from the top wall 1208 of the first stage 1210 of the counterbore 1212 rather than a side wall of the first stage 1210, may be similarly curved as the secondary nozzles 912 of FIGS. 9-12.

For example, the secondary nozzles 1216 may curve with respect to each of the z-, x-, and y-axes and swirl fuel in a clockwise direction when viewed from above along the z-axis, as shown in FIG. 13. In other words, each of the secondary nozzles 1216 may curve from an upstream end 1218 to a downstream end 1220 in the clockwise direction, driving clockwise flow of fuel into an inner volume of the first stage 1210, as indicated by arrows 1302 in FIG. 13. The swirling fuel interacts with turbulent fuel flow emerging from the primary nozzle 1214 within the first stage 1210 to enhance atomization of the fuel.

By adapting an injector tip with curved secondary nozzles, such as the embodiments of FIGS. 9-14, or angled secondary nozzles, such as the embodiments of FIGS. 3-7, higher interaction of fuel spray with air in combustion chambers receiving the fuel spray enables increased mixing of fuel with air. Furthermore the swirling of the fuel spray decreased a penetration of the spray, thereby reduces fuel losses. Thus application of the curved/angled secondary nozzles may be desirable for larger fuel flow rates during late compression injection at the combustion chambers.

The counterbore 1212 may direct atomized fuel away from the set of nozzles 1206 and reduce a likelihood of coking in the injector tip 1204. However, unlike the counterbore 312 of FIGS. 3-7 and similar to the counterbore 808 of FIG. 8, the counterbore 1212 of FIGS. 12-14 has two stages rather than three. The counterbore 1212 includes the first stage 1210 stacked on top of a second stage 1222 along the central axis, the first stage 1210 having a smaller diameter 1224 than a diameter 1226 of the second stage 1222. By configuring the counterbore 1212 with two stages, diameters of the set of nozzles 1206 may be increased relative to injector tips with three-stage counterbores. The wider diameters of the set of nozzles 1206 may be suitable for high fuel pressure conditions.

Figure 16:
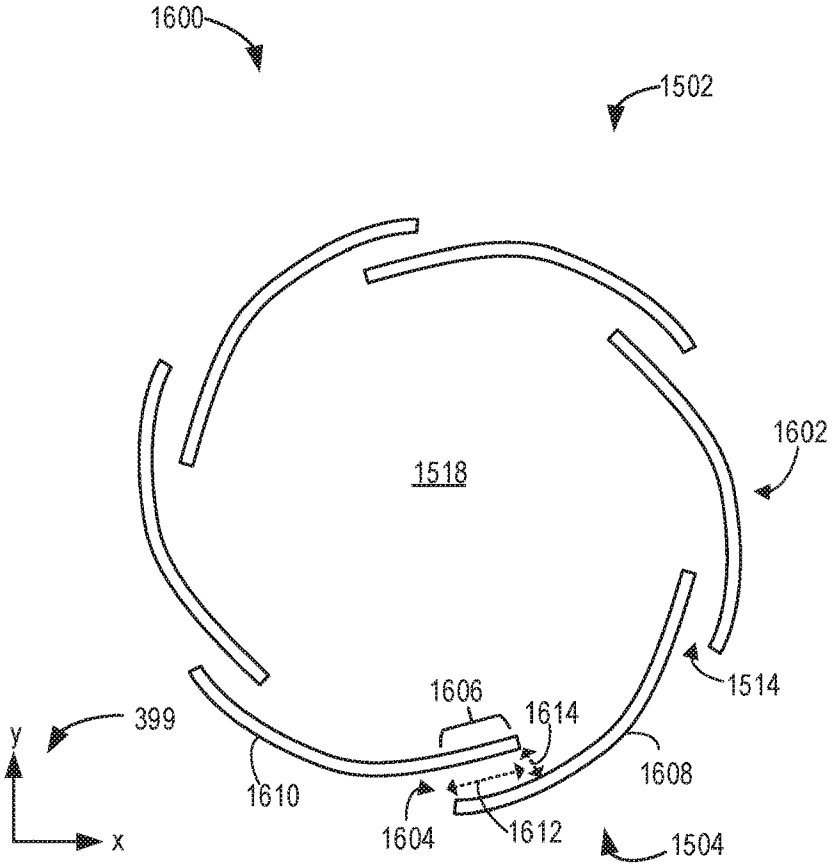
FIG. 16 shows a second cross-section of the fifth embodiment of the multi-nozzle injector tip.
Figure 15:
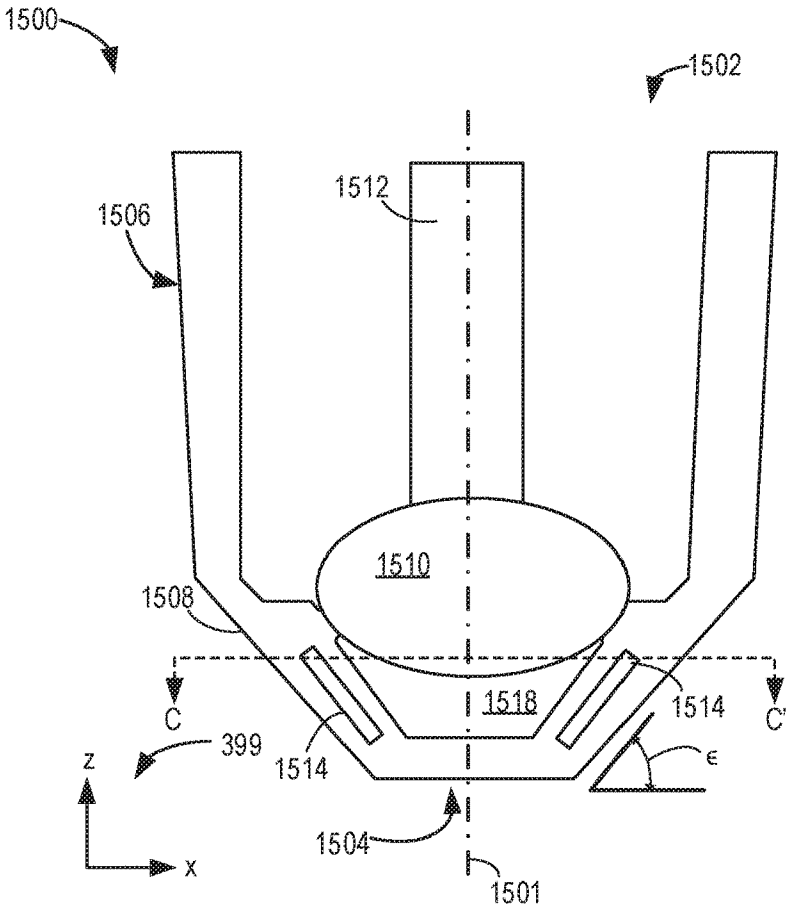
FIG. 15 shows a first cross-section of a fifth embodiment of a multi-nozzle injector tip.
Figure 17:
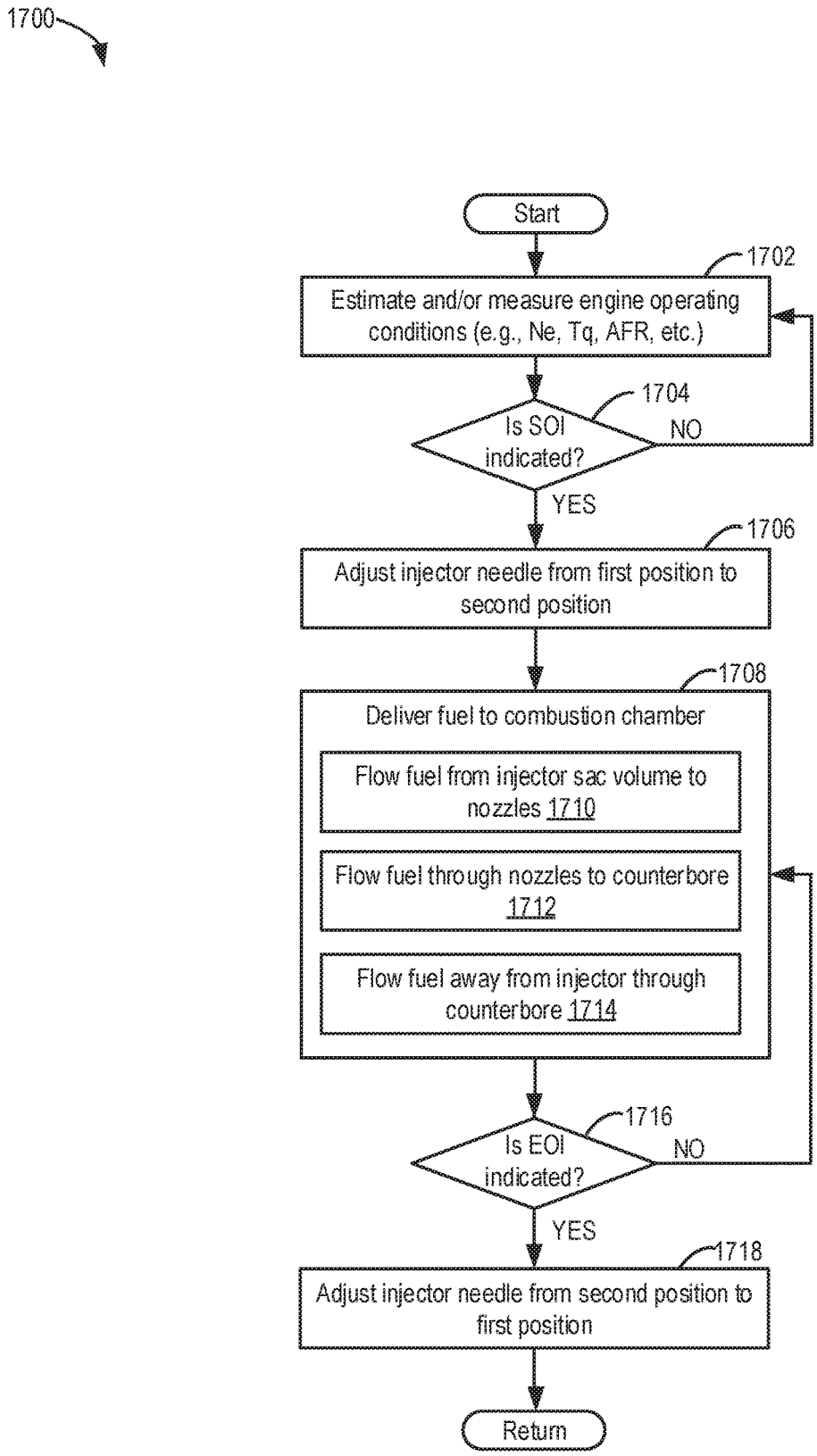
FIG. 17 shows an example of a routine for delivering fuel to a combustion chamber via a multi-nozzle injector tip.

A fifth embodiment 1502 of an injector tip 1504 is shown in a first cross-section 1500 in FIG. 15 and a second cross-section 1600 in FIG. 16. The first cross-section 1500 is taken along the z-x plane and shows a portion of an injector body 1506 including a valve seat body 1508. FIG. 15 also shows a valve closure member 1510 coupled to an injector needle 1512 within the injector body 1506. A plurality of nozzles 1514 are disposed in the valve seat body 1508, forming openings that are rectangular and inclined relative to a central axis 1501 of the injector body 1506. In one example, the plurality of nozzles 1514 may form an angle ϵ of 60 degrees with respect to the x-axis, as shown in FIG. 15.

The plurality of nozzles 1514 are also shown in the second cross-section 1600 of FIG. 16. The second cross-section is taken along line C-C' of FIG. 15, depicting a cutaway view of the valve seat body 1508 along the x-y plane. The plurality of nozzles 1514 may be gaps between overlapping portions of a plurality of partitions 1602 formed in the valve seat body 1508, as shown in FIG. 16, directly coupled to an injector sac volume 1518, as shown in FIG. 15, and fluidly coupling the injector sac volume 1518 to air surrounding and external to the injector body 1506. The plurality of partitions 1602 may be each be a section of a wall of the valve seat body 1508 separated from adjacent partitions by the plurality of nozzles 1514. The plurality of partitions 1602 may be arranged in a circle, surrounding the injector sac volume 1518. Fuel may thereby flow from the injector sac volume 1518 through the plurality of nozzles 1514 and out of the injector body 1506.

For example, a first nozzle 1604 of the plurality of nozzles 1514 may be formed of an overlapping portion 1606 between a first partition 1608 of the plurality of partitions 1602 and a second partition 1610 of the plurality of partitions 1602. Each nozzle of the plurality of nozzles 1514 may have a length 1612 equal to a length of the overlapping portion 1606 of the plurality of partitions 1602 and a width of, for example, 0.06 mm. A geometry of the injector tip 1504 allows fuel to be swirled and atomized and the fuel emerges from the plurality of nozzles 1514 to be sprayed into a combustion chamber. The configuration of the injector tip 1504 precludes a counterbore, enabling the plurality of nozzles 1514 to have smaller dimensions, e.g., length and width, than conventional injector tips or any of the embodiments of FIGS. 2-14. However, in some examples, the counterbore, configured with more than one stage, may be coupled to outlets of the plurality of nozzles.

For example a three-stage counterbore may be coupled to the injector tip 1504. The narrow diameters of the plurality of nozzles 1514 may be combined with the three-stage counterbore to release fuel to a combustion chamber at a farther distance away from a flame front of the combustion chamber. The counterbore may provide a barrier blocking the flame front from reaching outlets of the plurality of nozzles 1514. As a result, the outlets of the plurality of nozzles 1514 may be exposed to lower gas temperatures than at the flame front and coking is reduced.

In other examples, the injector tip 1504 may have a different quantity of nozzles of the plurality of nozzles 1514 from the six nozzles shown in FIG. 16. For example, the injector tip 1504 may five partitions included in the plurality of partitions 602 and five nozzles included in the plurality of nozzles 1514. The injector tip 1504 may therefore have a pentagonal shape along the x-y plane, with each partition having a similar length or a trapezoidal shape with one partition of the plurality of partitions 602 having a longer length than an oppositely arranged partition.

An example of a routine 1700 for delivering fuel to a combustion chamber of an engine via a timed direction injection system from a fuel injector, such as the fuel injector 166 of FIG. 1 and 200 of FIG. 2 is shown in FIG. 17. The fuel injector may be adapted with a multi-nozzle, multi-stage counterbore injector tip, such as the examples of an injector tip shown in FIGS. 2-14. A position of the of the fuel injector, e.g., open to inject fuel or closed to block fuel flow, may be adjusted based on a pulse width of a signal FPW-1 received from a controller, such as the controller 12 of FIG. 1. Instructions for carrying out routine 1700 and the rest of the methods included herein may be executed by a controller based on instructions stored on a memory of the controller and in conjunction with signals received from sensors of the engine system, such as the sensors described above with reference to FIG. 1. The controller may employ engine actuators of the engine system to adjust engine operation, according to the methods described below. For example, the controller may receive information from an exhaust gas sensor, e.g., exhaust gas sensor 128 of FIG. 1, to infer an AFR of the engine and adjust the signal pulse width to the fuel injector accordingly.

At 1702, the routine includes estimate and/or measuring engine operating conditions such as engine speed, engine torque, an exhaust gas oxygen level, etc. The routine determines if a request for a start of injection (SOI) event is indicated at 1704. Determining if the SOI event is requested may include detecting a position of a piston in the combustion chamber based on, for example, a signal from a Hall effect sensor coupled to a crankshaft of the engine or detecting a position of intake and/or exhaust valves of the combustion chamber. For example, if the piston is approaching an induction stroke in a pulsed injection system, the controller may command fuel injection to initiate. However, in other examples, a timing of fuel injection relative to piston cycle may vary depending on a desired fuel injection timing.

If the SOI event request is not received, the routine returns to 1702 to estimate and/or measure engine operating conditions. Alternatively, responsive to a confirmation of the SOI event request, the routine continues to 1706 to adjust a needle of the fuel injector from a first position to a second position. The needle may be coupled to a valve closure member that, when in the first position, seals against a valve seat body of the injector to block fuel flow out of the fuel injector through the injector tip. Both the needle and the valve closure member may be enclosed within a body of the fuel injector along with a volume of fuel. Adjusting the needle to the second position may include energizing an actuation system, such as an electromagnetic actuator, to lift the needle and valve closure member away from the valve seat body, creating a gap between the valve closure member and the valve seat body.

At 1708, the routine includes delivering fuel to the combustion chamber. Delivering fuel includes, at 1710, flowing fuel from the injector body, through a sac volume of the fuel injector to a set of nozzles disposed in the injector tip. The injector sac volume may be a space between the valve closure member and inner surfaces of the valve seat body. As fuel travels into the set of nozzles from the sac volume, a portion of the fuel may pass through a primary nozzle of the set of nozzles. The primary nozzle may have a constriction in a central portion of the primary nozzle that imposes a Venturi effect on fuel flow, increasing flow through the primary nozzle by aspiration. Turbulence in the flow is also increased as the fuel is discharged from the primary nozzle at an outlet of the primary nozzle. A remainder of the fuel flow, e.g., a portion that does not flow through the primary nozzle, may flow through secondary nozzles of the set of nozzles that circumferentially surround the primary nozzle, spaced away from the primary nozzle and from one another.

The fuel passing through the secondary nozzles may be rotated due to a geometry of the secondary nozzles. For example, the secondary nozzles may be inclined or angled, as shown in FIGS. 3-7, 9-14, and 15-16, to encourage swirling of the fuel emerging from outlets of the secondary nozzles. Delivering fuel to the combustion chambers may also include flowing fuel from the set of nozzles to the counterbore at 1712. The counterbore may have more than one stage, each stage having a larger diameter than an adjacent upstream stage. The counterbore may be directly coupled and integrated with the downstream end of the injector body. Fuel exiting the primary nozzle and the secondary nozzles combine in the counterbore, where mixing of turbulent flow from the primary nozzle and swirling flow from the secondary nozzles produces cavitation that atomizes the fuel into tiny droplets.

Delivery of fuel to the combustion chamber may further include flowing the fuel through the counterbore away from the outlets of the set of nozzles at 1714. The increasing diameters of the counterbore, along the downstream direction, compels the atomized fuel to flow along the downstream direction, thereby reducing a likelihood of coking when the fuel encounters elevated temperatures in the combustion chamber.

At 1716, the routine includes determining if a request for an end of injection (EOI) event is detected. Detecting the request for the EOI event may include, for example, estimating a position of the piston via the Hall effect sensor or a position of intake and/or exhaust valves of the combustion chamber to determine, for example, if the piston is approaching a compression stroke. However, in other examples, a timing of fuel injection termination may vary depending on a desired fuel injection timing relative to piston cycling. If the EOI event is not requested, the routine returns to 1708 to continue delivering fuel to the combustion chamber. Responsive to confirmation that EOI event is requested, the routine proceeds to 1718 to adjust the injector needle position. The controller may command the injector to terminate fuel delivery by instructing the actuating system to de-energize and lower the injector needle, adjusting the injector needle from the second position to the first position. Fuel flow through the fuel injector is thereby halted and the routine returns to the start.

In this way, by equipping an engine with a multi-nozzle, multi-stage counterbore fuel injector, an injector tip of the fuel injector may spray fuel with a high degree of atomization. The injector tip may be adapted with a set of nozzles that fluidly couple a sac volume of the injector to air surrounding the injector tip. The set of nozzles may have a geometry that enhances turbulence and induces swirling of fuel flow to increase cavitation, thereby decreasing a droplet size of the fuel as the fuel exits the set of nozzles. In some examples, the injector tip may also include a multi-stage counterbore configured to receive fuel emerging from the set of nozzles and direct the fuel stream away from the set of nozzles to reduce coking. The counterbore may be coupled to a downstream end of the injector and include more than one stage with increasing diameters. As a result of the geometry of the set of nozzles and the arrangement of the counterbore, a length and diameter of each of the nozzles may be reduced, thereby mitigating a loss of pressure along the set of nozzles that may otherwise degrade fuel atomization and increase coking.

The technical effect of implementing an injector tip of a fuel injector with multiple nozzles and a multi-stage counterbore is that a useful lifetime of the injector and a fuel efficiency of an engine is increased.

In one embodiment, a method includes actuating an injector needle from a first position to a second position to open a venturi-shaped primary nozzle of the fuel injector and a plurality of secondary nozzles circumferentially arranged around the primary nozzle, and delivering fuel from an injector sac of the fuel injector to a cylinder of an engine via the primary nozzle, the plurality of secondary nozzles, a first stage of a counterbore coupled to the primary nozzle and the plurality of secondary nozzles, and a second stage of the counterbore coupled to the first stage. In a first example of the method supplying the fuel to the fuel injector from a fuel system including a fuel rail. A second example of the method optionally includes the first example, and further includes, wherein actuating the injector needle from the first position to the second position includes actuating the injector needle from the first position to the second position in response to a start of injection command, and further comprising ceasing the actuation of the injector needle in response to an end of injection command, wherein upon ceasing of the actuation of the injector needle, the injector needle moves back to the first position to close the primary nozzle and plurality of secondary nozzles.

In another embodiment, a system includes a cylinder and a direct fuel injector coupled to the cylinder, the direct fuel injector including an injector needle, an injector sac, and an injector tip, the injector tip including a primary nozzle, a plurality of secondary nozzles circumferentially surrounding the primary nozzle, and a counterbore including a first stage coupled to an outlet of the primary nozzle and each outlet of the plurality of secondary nozzles and a second stage coupled to the first stage, and a controller storing instructions in non-transitory memory that are executable by a processor to actuate the injector needle from a first position to a second position to open the primary nozzle and the plurality of secondary nozzles, the primary nozzle and the plurality of secondary nozzles each having an inlet coupled to the injector sac such that, when open, fuel is delivered from the injector sac to the cylinder via the primary nozzle and plurality of secondary nozzles. In a first example of the system, the primary nozzle and the plurality of secondary nozzles are passages formed in a wall of a body of the direct fuel injector. A second example of the system optionally includes the first example, and further includes, wherein the outlet of the primary nozzle and each outlet of the plurality of secondary nozzles define openings in an upstream wall of the first stage of the counterbore, the upstream wall perpendicular to a central axis of the counterbore. A third example of the system optionally includes one or more of the first and second examples, and further includes, wherein the outlet of the primary nozzle defines an opening in an upstream wall of the first stage of the counterbore, the upstream wall perpendicular to a central axis of the counterbore, and wherein each outlet of the plurality of secondary nozzles defines a respective opening in a side wall of the first stage of the counterbore, the side wall parallel with the central axis of the counterbore. A fourth example of the system optionally includes one or more of the first through third examples, and further includes, wherein the first stage of the counterbore is directly coupled to and integrated with a body of the direct fuel injector. A sixth example of the system optionally includes one or more of the first through fourth examples, and further includes, wherein the inlet of the primary nozzle and each inlet of the plurality of secondary nozzles are aligned along a common plane. A seventh example of the system optionally includes one or more of the first through fifth examples, and further includes, wherein an inner volume of the first stage of the counterbore is a mixing area configured to receive fuel from the outlet of the primary nozzle and each outlet of the plurality of secondary nozzles.

In yet another embodiment, a fuel injector includes a primary nozzle including an inlet, an outlet, and a throat, the inlet and the outlet each having a larger diameter than a diameter of the throat, a plurality of secondary nozzles circumferentially surrounding the primary nozzle, and a counterbore including a first stage and a second stage coupled to the first stage, the first stage coupled to the outlet of the primary nozzle and each outlet of the plurality of secondary nozzles, the second stage having a larger diameter than a diameter of the first stage. In a first example of the fuel injector, an injector sac housed in an injector body of the fuel injector, and wherein the injector sac is fluidly coupled to the inlet of the primary nozzle and each inlet of the plurality of secondary nozzles. A second example of the fuel injector optionally includes the first example and further includes wherein each secondary nozzle of the plurality of secondary nozzles includes a vertically straight passage extending from an inlet of that secondary nozzle to a point between the inlet and an outlet of that secondary nozzle. A third example of the fuel injector optionally includes one or more of the first and second examples, and further includes, wherein each secondary nozzle further includes an inclined passage extending between the outlet of that secondary nozzle and an outlet of the vertically straight passage. A fourth example of the fuel injector optionally includes one or more of the first through third examples, and further includes, wherein each secondary nozzle includes a curved passage extending from an inlet of that secondary nozzle to an outlet of that secondary nozzle. A fifth example of the fuel injector optionally includes one or more of the first through fourth examples, and further includes, wherein each secondary nozzle includes a straight passage extending from an inlet of that secondary nozzle to an outlet of that secondary nozzle. A sixth example of the fuel injector optionally includes one or more of the first through fifth examples, and further includes, wherein the first stage and the second stage of the counterbore share a common inner volume. A seventh example of the fuel injector optionally includes one or more of the first through sixth examples, and further includes, wherein the counterbore further includes a third stage coupled to the second stage of the counterbore, the third stage having a larger diameter than both the diameter of the first stage and the diameter of the second stage and sharing a common inner volume with the first stage and the second stage. An eighth example of the fuel injector optionally includes one or more of the first through seventh examples, and further includes, wherein the first stage, the second stage, and the third stage are stacked along a central axis of the fuel injector and form a continuous unit. A ninth example of the fuel injector optionally includes one or more of the first through eighth examples, and further includes, wherein the primary nozzle has a central longitudinal axis, and wherein a first centerpoint of the first stage of the counterbore and a second centerpoint of the second stage of the counterbore are aligned along the central longitudinal axis.

In another representation, a method includes actuating a fuel injector to an open position, based on a start-of-injection request to flow fuel from an inner sac volume of the fuel injector to a combustion chamber through an injector tip adapted with a plurality of nozzles configured to rotate fuel flow and generate turbulence. In a first example of the method, flowing fuel from the fuel injector to the combustion chamber further includes flowing fuel from the plurality of nozzles to a multi-stage counterbore, the multi-stage counterbore having a diameter increasing along a downstream direction. A second example of the method optionally includes the first example, and further includes, wherein flowing the fuel through the injector tip includes flowing the fuel through a primary nozzle aligned with a central axis of the injector and through secondary nozzles aligned off-axis and spaced away from the primary nozzle.

In yet another representation, a fuel injector includes a tip having a plurality of partitions defined in a wall of the tip and arranged in a circle and each of the plurality of partitions spaced away from and overlapping with adjacent partitions of the plurality of partitions along a portion of a length of each of the adjacent partitions, nozzles defined by gaps between the overlapping portions of the plurality of partitions, wherein the nozzles fluidly couple a sac volume of the fuel injector to a combustion chamber. In a first example of the fuel injector, the nozzles are configured to flow fuel from the sac volume of the fuel injector to the combustion chamber along a rotating flow path. A second example of the fuel injector optionally includes the first example, and further includes, wherein a length of each of the nozzles is greater than a width of each of the nozzles. A third example of the fuel injector optionally includes one or more of the first and second examples, and further includes, where the nozzles are inclined relative to a central axis of the fuel injector. A fourth example of the fuel injector optionally includes one or more of the first through third examples, and further includes, wherein the nozzles are arranged around a circumference of the tip of the fuel injector.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system, comprising:

a cylinder; and a direct fuel injector coupled to the cylinder, the direct fuel injector including an injector needle, an injector sac, and an injector tip, the injector tip including a primary nozzle, a plurality of secondary nozzles circumferentially surrounding the primary nozzle, and a counterbore including a first stage coupled to an outlet of the primary nozzle and each outlet of the plurality of secondary nozzles and a second stage coupled to the first stage, wherein the first stage of the counterbore is directly coupled to and integrated with a body of the direct fuel injector; and a controller storing instructions in non-transitory memory that are executable by a processor to:

actuate the injector needle from a first position to a second position to open the primary nozzle and the plurality of secondary nozzles, the primary nozzle and the plurality of secondary nozzles each having an inlet coupled to the injector sac such that, when open, fuel is delivered from the injector sac to the cylinder via the primary nozzle and plurality of secondary nozzles.

2. The system of claim 1, wherein the primary nozzle and the plurality of secondary nozzles are passages formed in a wall of a body of the direct fuel injector.

3. The system of claim 1, wherein the outlet of the primary nozzle and each outlet of the plurality of secondary nozzles define openings in an upstream wall of the first stage of the counterbore, the upstream wall perpendicular to a central axis of the counterbore.

4. The system of claim 1, wherein the outlet of the primary nozzle defines an opening in an upstream wall of the first stage of the counterbore, the upstream wall perpendicular to a central axis of the counterbore, and wherein each outlet of the plurality of secondary nozzles defines a respective opening in a side wall of the first stage of the counterbore, the side wall parallel with the central axis of the counterbore.

5. The system of claim 1, wherein the inlet of the primary nozzle and each inlet of the plurality of secondary nozzles are aligned along a common plane.

6. The system of claim 1, wherein an inner volume of the first stage of the counterbore is a mixing area configured to receive fuel from the outlet of the primary nozzle and each outlet of the plurality of secondary nozzles.

7. A fuel injector, comprising:

a primary nozzle including an inlet, an outlet, and a throat, the inlet and the outlet each having a larger diameter than a diameter of the throat;

a plurality of secondary nozzles circumferentially surrounding the primary nozzle;

an injector sac housed in an injector body of the fuel injector, and wherein the injector sac is fluidly coupled to the inlet of the primary nozzle and each inlet of the plurality of secondary nozzles; and a counterbore including a first stage and a second stage coupled to the first stage, the first stage coupled to the outlet of the primary nozzle and each outlet of the plurality of secondary nozzles, the second stage having a larger diameter than a diameter of the first stage.

8. The fuel injector of claim 7, wherein each secondary nozzle of the plurality of secondary nozzles includes a vertically straight passage extending from an inlet of that secondary nozzle to a point between the inlet and an outlet of that secondary nozzle.

9. The fuel injector of claim 8, wherein each secondary nozzle further includes an inclined passage extending between the outlet of that secondary nozzle and an outlet of the vertically straight passage.

10. The fuel injector of claim 7, wherein each secondary nozzle includes a curved passage extending from an inlet of that secondary nozzle to an outlet of that secondary nozzle.

11. The fuel injector of claim 7, wherein each secondary nozzle includes a straight passage extending from an inlet of that secondary nozzle to an outlet of that secondary nozzle.

12. The fuel injector of claim 7, wherein the first stage and the second stage of the counterbore share a common inner volume.

13. The fuel injector of claim 7, wherein the counterbore further includes a third stage coupled to the second stage of the counterbore, the third stage having a larger diameter than both the diameter of the first stage and the diameter of the second stage and sharing a common inner volume with the first stage and the second stage.

14. The fuel injector of claim 13, wherein the first stage, the second stage, and the third stage are stacked along a central axis of the fuel injector and form a continuous unit.

15. The fuel injector of claim 7, wherein the primary nozzle has a central longitudinal axis, and wherein a first centerpoint of the first stage of the counterbore and a second centerpoint of the second stage of the counterbore are aligned along the central longitudinal axis.

16. A method for a fuel injector, comprising:

actuating an injector needle from a first position to a second position to open a venturi-shaped primary nozzle of the fuel injector and a plurality of secondary nozzles circumferentially arranged around the primary nozzle;

delivering fuel from an injector sac of the fuel injector to a cylinder of an engine via the primary nozzle, the plurality of secondary nozzles, a first stage of a counterbore coupled to the primary nozzle and the plurality of secondary nozzles, and a second stage of the counterbore coupled to the first stage; and supplying the fuel to the fuel injector from a fuel system including a fuel rail.

17. The method of claim 16, wherein actuating the injector needle from the first position to the second position includes actuating the injector needle from the first position to the second position in response to a start of injection command, and further comprising ceasing the actuation of the injector needle in response to an end of injection command, wherein upon ceasing of the actuation of the injector needle, the injector needle moves back to the first position to close the primary nozzle and plurality of secondary nozzles.

* * * * *